US006980225B2

(12) United States Patent
Funamoto et al.

(10) Patent No.: US 6,980,225 B2
(45) Date of Patent: Dec. 27, 2005

(54) IMAGE DISPLAY APPARATUS AND METHOD

(75) Inventors: Taro Funamoto, Mino (JP); Wataru Machidori, Amagasaki (JP); Katsuyuki Arimoto, Okayama (JP); Yoshihito Ohta, Okayama (JP); Takahiro Kobayashi, Okayama (JP); Yasuhiro Kumamoto, Neyagawa (JP); Tetsuo Kariya, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 260 days.

(21) Appl. No.: 10/297,081

(22) PCT Filed: Mar. 20, 2002

(86) PCT No.: PCT/JP02/02636

§ 371 (c)(1),
(2), (4) Date: Dec. 2, 2002

(87) PCT Pub. No.: WO02/077959

PCT Pub. Date: Oct. 3, 2002

(65) Prior Publication Data

US 2003/0142118 A1 Jul. 31, 2003

(30) Foreign Application Priority Data

Mar. 26, 2001 (JP) ..... 2001-088162

(51) Int. Cl.[7] ..... G09G 5/10

(52) U.S. Cl. ..... 345/691; 345/102; 345/692; 345/693; 349/61

(58) Field of Search ..... 345/102, 691, 345/692, 693; 349/61

(56) References Cited

U.S. PATENT DOCUMENTS 4,799,050 A * 1/1989 Prince et al. ..... 349/71
5,844,540 A * 12/1998 Terasaki ..... 345/102
5,870,075 A * 2/1999 Yamazaki et al. ..... 345/92
5,926,174 A * 7/1999 Shibamiya et al. ..... 345/213
6,097,368 A * 8/2000 Zhu et al. ..... 345/601

(Continued)

FOREIGN PATENT DOCUMENTS

CN 1279459 1/2001

(Continued)

OTHER PUBLICATIONS

"Picture Quality of Hold Type Display for Moving Images", Taiichiro Kurita, NHK Science and Technical Research Laboratories, Technical Report of IEICE, EID99-10(Jun. 1999), pp. 55-60, English abstract.

*Primary Examiner*—Sumati Lefkowitz
*Assistant Examiner*—Alexander S. Beck
(74) *Attorney, Agent, or Firm*—Wenderoth, Lind & Ponack, L.L.P.

(57) ABSTRACT

A liquid crystal display apparatus that uses a backlight for display includes a video signal time compression circuit for compressing a video signal in the time axis direction and outputting the time-compressed video signal, an LCD controller for driving a liquid crystal panel based on the time-compressed video signal, and a source driver and a gate driver. The liquid crystal display apparatus also includes a motion detection circuit for detecting the amount of motion of a display image based on the video signal, a PWM modulation pulse generation circuit for generating modulation pulses different in frequency according to the detection result from the motion detection circuit, and an inverter for lighting up the backlight based on the modulation pulses, to thereby enable reduction of image contour blurring in a moving image and reduction of flicker in a still image.

24 Claims, 19 Drawing Sheets

U.S. PATENT DOCUMENTS

| | | | | |
|---|---|---|---|---|
| 6,232,963 | B1 * | 5/2001 | Tew et al. | 345/204 |
| 6,496,194 | B1 * | 12/2002 | Mikoshiba et al. | 345/596 |
| 6,750,837 | B1 * | 6/2004 | Kondoh | 345/97 |
| 6,762,743 | B2 * | 7/2004 | Yoshihara et al. | 345/102 |
| 6,791,527 | B2 * | 9/2004 | Yoshinaga et al. | 345/102 |
| 2002/0067332 | A1 * | 6/2002 | Hirakata et al. | 345/102 |

FOREIGN PATENT DOCUMENTS

| | | |
|---|---|---|
| EP | 1 061 499 | 12/2000 |
| JP | 5-103314 | 4/1993 |
| JP | 6-47989 | 6/1994 |
| JP | 8-500915 | 1/1996 |
| JP | 9-127436 | 5/1997 |
| JP | 2000-056738 | 2/2000 |
| JP | 2000-56738 | 2/2000 |
| JP | 2000-267635 | 9/2000 |
| JP | 2000-293142 | 10/2000 |
| JP | 2001-125066 | 5/2001 |
| JP | 2002-123223 | 4/2002 |

* cited by examiner

FIG. 14 - PRIOR ART

FIG. 15 - PRIOR ART

FIG. 16 - PRIOR ART

FIG. 17 - PRIOR ART

IMAGE DISPLAY APPARATUS AND METHOD

TECHNICAL FIELD

The present invention relates to an image display apparatus and method. More particularly, the present invention relates to an image display apparatus and method for displaying an image by driving a passive light modulation device, which modulates light from a light source in a pixel-by-pixel manner based on an electric signal, based on a video signal compressed in the time axis direction.

BACKGROUND ART

In CRTs used for image display apparatuses, an electron beam strikes a phosphor surface to cause light emission. When measured for a miniscule period of time, each point of the screen is displayed only for an extremely short time by persistence of the phosphor. In CRTs, this point emission is sequentially scanned, to display an image of one frame using the persistence of vision by the eyes. This type of display device is called an impulse type display device.

In liquid crystal displays, a light modulation device generally called a hold type display device is used. In liquid crystal displays, display data is written in pixels arrayed in a matrix once for each frame using data lines (source lines) and address lines (gate lines). Each pixel holds the display data for the duration of one frame. That is, in liquid crystal displays, the screen is still being constantly displayed even when measured for a period of time smaller than one frame period.

In such a hold type image display apparatus, there occurs a visual phenomenon where the contour of a moving image is blurred. Taiichiro Kurita, "Picture Quality of Hold Type Display for Moving Images", Technical Report of IEICE, EID99-10 (1999-06) reports why this phenomenon occurs and proposes methods for improving on this problem. From this report, it is found that the display quality of moving images can be greatly improved by shortening the display period in the frame time direction to a half or less of one frame.

An image display apparatus described in Japanese National Phase PCT Laid-Open Publication No. 08-500915 (hereinafter, simply called the conventional apparatus) is known as an image display apparatus capable of solving the above problem, in which the display period in the frame time direction is shortened to a half or less of one frame as proposed above to thereby provide a liquid crystal display with a feature close to the impulse type display. Hereinafter, this conventional apparatus will be described.

FIG. 14 illustrates a configuration of the conventional apparatus. The conventional apparatus includes a video signal time compression circuit 101, a PWM modulation pulse generation circuit 102, an inverter 103, a backlight 104, a liquid crystal (LCD) panel 105, an LCD controller 106, a source driver 107 and a gate driver 108. The LCD panel 105, the source driver 107, the gate driver 108, the LCD controller 106 and the backlight 104 are those used for general TFT liquid crystal displays, and therefore detailed descriptions of these components are omitted here.

FIG. 15 is a timing chart of the operation of the conventional apparatus. Hereinafter, referring to FIG. 15 as necessary, the operation of the conventional apparatus will be described. A video signal is inputted at the time at which the screen is sequentially scanned from the top to the bottom. In a signal timing scheme called VGA, the number of effective scanning lines is 480, the total number of scanning lines is 525, and the vertical synchronizing signal frequency is 60 Hz, in general. Under VGA, the time required from the input of the uppermost line of a screen until the input of the lowermost line of the screen is 480/525/60 [s]=15.2 [ms]. This time length is compressed with the video signal time compression circuit 101.

FIG. 16 illustrates a configuration of the video signal time compression circuit 101. The video signal time compression circuit 101 includes a dual port RAM 109, a write address control circuit 110, a read address control circuit 111 and a synchronizing signal control circuit 112. The dual port RAM 109 is a random access memory in which a write address/data port and a read address/data port are provided separately to enable independent write and read operations. An input video signal is inputted to the write port of the dual port RAM 109, and written in the dual port RAM 109 according to a write address outputted from the write address control circuit 110. The video signal data written in the dual port RAM 109 is read from the dual port RAM 109 according to a read address outputted from the read address control circuit 111, and outputted therefrom. The synchronizing signal control circuit 112, which receives an input vertical synchronizing signal, an input horizontal synchronizing signal and an input clock, controls the write address control circuit 110 and the read address control circuit 111, and outputs an output horizontal synchronizing signal and an output clock having frequencies increased from those of the inputs.

The operation of the video signal time compression circuit 101 of FIG. 16 will be described with reference to FIG. 17. The write address outputted from the write address control circuit 110 is counted with the input clock, and is reset with every input vertical synchronizing signal, i.e., every vertical blanking period. The data written to the dual port RAM 109 is the input video signal, each frame of which is stored in the dual port RAM 109. The output clock is generated by changing the input clock to a high-frequency clock by using a PLL synthesizer or the like. The read address is counted with the output clock, and is reset upon completion of read of data of each frame. The count of the read address is then stopped until it is restarted in synchronization with the reset timing of the count of the write address. By the operation described above, each frame of the input video signal is outputted in a time shorter than that required for the input.

The actual setting of the time required from the input of the uppermost line of a screen until the write of the lowermost line of the screen must be made in consideration of the write capabilities to liquid crystal pixels, such as the ON resistance of TFTs, the wiring resistance of gate lines and source lines, the pixel capacitance and the floating capacitance. The liquid crystal panel that permits the shortest TFT write time among those currently released as products is that of the UXGA resolution (1600 pixels horizontal×1200 pixels vertical). Since 1200/480 =2.5 considering the number of effective lines, the write time can be compressed by 1/2.5 for a panel of the VGA resolution. In other words, in this panel, the time required from the write of the uppermost line of a screen until the write of the lowermost line of the screen can be compressed from 15.2 ms to 6 ms.

In the liquid crystal panel 105, the liquid crystal is driven with data written in the respective TFT pixels. It is generally known that the response speed of liquid crystal is finite and low. In recent years, however, high-speed response liquid crystal such as optically self-compensated birefringence mode (OCB) liquid crystal has attracted attention. The OCB liquid crystal has exhibited a response time of about 4 ms (falling or rising time) in gray scale images, for example.

As shown in FIG. 15, for the display data written sequentially from the uppermost line of a screen, the liquid crystal starts responding sequentially from the uppermost line of the screen. Assume that the write time of one frame is 6 ms and the response time of liquid crystal (falling or rising time) is 4 ms, the time required from the write of the uppermost line of the screen until completion of the response of the lowermost line of the screen is 6+4=10 ms.

The PWM modulation pulse generation circuit 102 generates a modulation pulse having a width of 6.7 ms synchronizing with the vertical synchronizing signal. FIG. 18 shows the waveform of a lamp current for lighting up a cold-cathode tube as the light source of the backlight 104. The oscillating frequency of the inverter 103 is normally set at about 50 kHz in many cases. It is general practice to intermittently oscillate an inverter according to the waveform shown in FIG. 18, and this is called PWM modulation. In PWM modulation, the brightness of a lamp is controlled by changing the width of a modulation pulse for intermittent ON/OFF control of oscillation. The PWM modulation pulse generation circuit 102 generates the modulation pulse shown in FIG. 15 based on the vertical synchronizing signal. The inverter 103 controlled with this modulation pulse drives the backlight 104, to allow the backlight 104 to emit light for a duration of 6.7 ms. Thus, an image is displayed for only the duration of 6.7 ms in one frame period.

With the operation described above, the conventional apparatus overcomes the disadvantage of the liquid crystal device as a hold type display device, i.e., the phenomenon where the contour of a moving image is blurred.

However, in the conventional apparatus, flicker is generated because the backlight blinks at a frequency of 60 Hz in synchronization with the vertical synchronizing signal. This disadvantageously impairs the inherent advantage of liquid crystal displays that little flicker is generated and thus the viewer feels less fatigued when gazing at display details such as text characters.

The conventional apparatus has another problem in that the effect of improving on the blurring of a moving image decreases and the contour of a moving image is colored in the upper portion of the screen. Hereinafter, the causes of this decrease in the blurring improving effect and the coloring will be described.

In general, as for the phosphors for the cold-cathode tube fluorescent lamp used as the backlight 104, YOX is used as a read phosphor, LAP as a green phosphor, and BAM (or SCA) as a blue phosphor. FIG. 19 shows examples of persistent response characteristics of the respective phosphors. As seen from the figure, the persistence time of the green phosphor (LAP) is the longest, which is about 6.5 ms. The modulation pulse width shown in FIG. 15 can only be as great as 6.7 ms, considering the limitations of the currently achievable write capabilities to liquid crystal and the response time of liquid crystal as described above, whereas the persistence time of a currently typical fluorescent lamp is about 6.5 ms. This indicates that, during the time of about 6.5 ms shown by A in FIG. 15, the persistence of the backlight remains while an image signal for the next frame is written in the upper portion of the screen. Therefore, in a scene having motion, two frames may appear overlapping with each other, or the blurring of contours may not be improved in the upper portion of the screen. Moreover, the persistence times of the blue phosphor (BAM) and the red phosphor (YOX), which are about 0.1 ms and about 1.5 ms, respectively, are short compared with that of the green phosphor. Therefore, the overlap of two frames and the blurring of the contour in the upper portion of the screen described above occur only for green, and this results in coloring of the contour in green or magenta. The persistence time of the blue phosphor SCA is substantially the same as that of the blue phosphor BAM.

In view of the above, an object of the present invention is to provide an image display apparatus capable of improving on the problem of flicker while improving on motion blurring in a moving image. Another object of the present invention is to provide an image display apparatus capable of minimizing motion blurring and contour coloring that may occur on part of a screen while improving on motion blurring in a moving image.

SUMMARY OF THE INVENTION

To attain the objects described above, the present invention has features as described below.

A first aspect is directed to an image display apparatus for displaying an image by driving a passive light modulation device based on a video signal compressed in the time axis direction, the passive modulation device modulating light from a light source in a pixel-by-pixel manner based on an electric signal, the apparatus including:

motion detection means for detecting the amount of motion of a display image based on the video signal;

modulation pulse generation means for generating modulation pulses different in period, phase or pulse width according to the detection result from the motion detection means; and light source driving means for enabling the light source to emit light at optimum timing corresponding to the motion amount by intermittently driving the light source according to the modulation pulses generated by the modulation pulse generation means.

As described above, in the first aspect, the timing of emission of the light source is changed according to the motion of the display image, and this enables reduction of the image contour blurring in a moving image, as well as attainment of higher-quality image display.

According to a second aspect, the image display apparatus of the first aspect further includes comparison means for comparing the motion amount detected by the motion detection means with a predetermined amount, wherein the modulation pulse generation means outputs a first modulation pulse synchronizing with a vertical synchronizing signal and having the same frequency as the vertical synchronizing signal when the motion amount is greater than the predetermined amount, and outputs a second modulation pulse having a frequency higher than the first modulation pulse when the motion amount is smaller than the predetermined amount.

As described above, in the second aspect, the problem of image blurring generated when the motion amount of the display image is great is improved. In addition, the emission frequency of the light source is made greater when the motion amount of the display image is smaller than when it is greater, to enable reduction of flicker generated when the motion amount is small.

According to a third aspect based on the second aspect, the first modulation pulse and the second modulation pulse have the same pulse duty.

As described above, in the third aspect, the luminance is prevented from changing with change of the frequency of the modulation pulse.

According to a fourth aspect based on the second aspect, the frequency of the second modulation pulse is high enough to prevent generation of flicker.

As described above, in the fourth aspect, flicker is prevented from being generated when the motion amount is small.

According to a fifth aspect based on the second aspect, the modulation pulse generation means includes:

first pulse generation means for outputting a pulse synchronizing with the vertical synchronizing signal and having the same frequency as the vertical synchronizing signal;

second pulse generation means f or outputting a pulse having a frequency higher than the pulse output from the first pulse generation means; and selector means for selecting the pulse outputted from the first pulse generation means or the pulse outputted from the second pulse generation means and outputting the selected pulse.

As described above, in the fifth aspect, the outputs from the two pulse generation means are selectable according to the comparison result, and thus two modulation pulses different in frequency according to the motion amount can be easily generated.

According to a sixth aspect based on the first aspect, the motion detection means detects the motion amount for each of a plurality of predetermined regions in the entire display area of the light modulation device, the image display apparatus further includes comparison means for comparing the motion amounts for the plurality of predetermined regions detected by the motion detection means with each other, and the modulation pulse generation means generates the modulation pulses different in synchronizing phase according to the comparison result from the comparison means.

As described above, in the sixth aspect, the timing of emission of the light source is controlled based on the motion amount for each region of the screen, and thus the quality of the display screen can be optimally improved as a whole.

According to a seventh aspect based on the sixth aspect, the plurality of predetermined regions include at least a first predetermined region in which data based on the video signal is written at a time comparatively early in one frame and a second predetermined region in which data based on the video signal is written at a time comparatively late in one frame, and the modulation pulse generation means generates a first modulation pulse having a synchronizing phase permitting emission of the light source at a comparatively early time when the motion amount in the first predetermined region detected by the motion detection means is greater than the motion amount in the second predetermined region, and generates a second modulation pulse having a synchronizing phase permitting emission of the light source at a comparatively late time when the motion amount in the first predetermined region detected by the motion detection means is smaller than the motion amount in the second predetermined region.

As described above, in the seventh aspect, it is determined whether the region in which data is written at an early time or the region in which data is written at a late time has a large or small motion amount. For the region having a comparatively large motion amount, the synchronizing phase of the modulation pulse is changed so that the influence of contour blurring or coloring in a moving image is comparatively lessened. In this way, the quality of the display screen can be optimally improved as a whole.

According to an eighth aspect based on the seventh aspect, the modulation pulse generation means includes:

count means for delaying a vertical synchronizing signal by a predetermined time according to the comparison result from the comparison means; and pulse output means for outputting a pulse based on the vertical synchronizing signal delayed by the count means.

As described above, in the eighth aspect, by controlling the delay time of the vertical synchronizing signal, the synchronizing phase of the modulation pulse can be easily controlled.

According to a ninth aspect based on the seventh aspect, when changing the output pulse with change of the comparison result from the comparison means, the modulation pulse generation means sequentially shifts the synchronizing phase of the output pulse stepwise by outputting a modulation pulse in a synchronizing phase somewhere between the synchronizing phase of the first modulation pulse and the synchronizing phase of the second modulation pulse.

As described above, in the ninth aspect, the synchronizing phase of the modulation pulse is changed by shifting stepwise, and this prevents occurrence of momentary change of luminance that may otherwise occur with abrupt change of the synchronizing phase of the modulation pulse.

According to a tenth aspect based on the ninth aspect, the modulation pulse generation means includes:

frame recursive low-pass filter means for outputting motion position data capable of taking on three or more values based on the comparison result from the comparison means;

count means for delaying a vertical synchronizing signal based on the motion position data outputted from the frame recursive low-pass filter means; and pulse output means for outputting a pulse based on the vertical synchronizing signal delayed by the count means.

As described above, in the tenth aspect, by use of the frame recursive low-pass filter, the modulation pulse can be easily shifted stepwise in three or more levels of gradation based on the comparison result.

According to an eleventh aspect based on the first aspect, the apparatus further includes pulse width determination means for determining the pulse width of the modulation pulse based on the motion amount detected by the motion detection means, wherein the modulation pulse generation means generates the modulation pulse having the pulse width determined by the pulse width determination means.

As described above, in the eleventh aspect, the length of the lighting-up time of the light source is changed according to the motion amount, and thus the balance between the improvement of contour blurring in a moving image and the amount of light from the light source can be optimally controlled according to the motion amount.

According to a twelfth aspect based on the eleventh aspect, the pulse width determined by the pulse width determination means becomes smaller as the motion amount detected by the motion detection means is greater, and becomes greater as the motion amount is smaller.

As described above, in the twelfth aspect, the pulse width of the modulation pulse is reduced when the motion amount is great, to improve on the problem of contour blurring and coloring in a moving image, and the modulation pulse width is increased when the motion amount is small, to ensure a sufficient amount of light from the light source.

According to a thirteenth aspect based on the eleventh aspect, the apparatus further includes:

gain determination means for determining the gain of the video signal based on the motion amount detected by the motion detection means; and gain control means for controlling the gain of the video signal according to the gain determined by the gain determination means.

As described above, in the thirteenth aspect, the change in luminance with the change of the pulse width of the modulation pulse can be compensated for by correction of the video signal.

According to a fourteenth aspect based on the thirteenth aspect, the gain determined by the gain determination means becomes greater as the pulse width determined by the pulse width determination means is smaller, and becomes smaller as the pulse width is greater.

As described above, in the fourteenth aspect, the gain of the video signal is increased as the pulse width of the modulation pulse is reduced, and is reduced as the modulation pulse width is increased, and thus the change of the luminance can be suppressed.

According to a fifteenth aspect based on the thirteenth aspect, the pulse width determination means and the gain determination means are a ROM table.

As described above, in the fifteenth aspect, the optimum pulse width and gain according to the motion amount can be easily determined with the ROM table.

According to a sixteenth aspect based on the first aspect, the motion detection means detects the motion amount based on a data difference between two continuous frames.

As described above, in the sixteenth aspect, the motion amount of the display image can be easily detected from the video signal based on a data difference between two continuous frames.

According to a seventeenth aspect based on the sixteenth aspect, the motion detection means includes:

frame memory means for delaying the video signal by one frame;

subtraction means for subtracting one of the video signal and a video signal delayed by the frame memory means from the other;

absolute means for calculating the absolute of the subtraction result from the subtraction means; and accumulation means for accumulating, for one frame, the output of the absolute means.

As described above, in the seventeenth aspect, the difference between a video signal delayed by one frame by the frame memory and the input video signal for each pixel is calculated and the calculated results are accumulated, and this enables easy detection of the motion amount of the display image from the image signal.

According to an eighteenth aspect based on the first aspect, the light source is a fluorescent lamp.

As described above, in the eighteenth aspect, an inexpensive apparatus can be obtained by use of a fluorescent lamp as the light source. Also, by improving on the problem of degradation of the image quality during display of a moving image due to the persistent response characteristic of the fluorescent lamp, higher-quality image display can be realized.

According to a nineteenth aspect based on the first aspect, the passive light modulation device is a liquid crystal display.

As described above, in the nineteenth aspect, by use of a liquid crystal display as the passive light modulation device, an inexpensive apparatus can be obtained. Also, by reducing image contour blurring in a moving image, higher-quality image display can be realized.

According to a twentieth aspect based on the first aspect, the passive light modulation device is a digital micromirror device (DMD) display.

As described above, in the twentieth aspect, by use of a DMD display as the passive light modulation device, a high-quality image display apparatus can be realized. Also, by reducing image contour blurring in a moving image, an even higher-quality image display can be realized.

A twenty-first aspect is directed to an image display method for displaying an image by driving a passive light modulation device based on a video signal compressed in the time axis direction, the passive modulation device modulating light from a light source in a pixel-by-pixel manner based on an electric signal, the method including:

a motion detection step of detecting the amount of motion of a display image based on the video signal;

a modulation pulse generation step of generating modulation pulses different in period, phase or pulse width according to the detection result in the motion detection step; and a light source driving step of emitting light from the light source at optimum timing corresponding to the motion amount by intermittently driving the light source according to the modulation pulses generated in the modulation pulse generation step.

As described above, in the twenty-first aspect, the timing of emission of the light source is changed according to the motion of the display image, and this enables reduction of the image contour blurring in a moving image, as well as attainment of higher-quality image display.

According to a twenty-second aspect based on the twenty-first aspect, in the modulation pulse generation step, a first modulation pulse synchronizing with a vertical synchronizing signal and having the same frequency as the vertical synchronizing signal is outputted when the motion amount detected in the motion detection step is greater than a predetermined amount, and a second modulation pulse having a frequency higher than the first modulation pulse is outputted when the motion amount is smaller than the predetermined amount.

As described above, in the twenty-second aspect, the problem of image blurring generated when the motion amount of the display image is great is improved. In addition, the emission period of the light source is made greater when the motion amount of the display image is small than when it is great, to enable reduction of flicker generated when the motion amount is small.

According to a twenty-third aspect based on the twenty-second aspect, the first modulation pulse and the second modulation pulse have the same pulse duty.

As described above, in the twenty-third aspect, the luminance is prevented from changing with change of the frequency of the modulation pulse.

According to a twenty-fourth aspect based on the twenty-second aspect, the frequency of the second modulation pulse is high enough to prevent generation of flicker.

As described above, in the twenty-fourth aspect, flicker is prevented from being generated when the motion amount is small.

According to a twenty-fifth aspect based on the twenty-first aspect, in the motion detection step, the motion amount is detected for each of a plurality of predetermined regions in the entire display area of the light modulation device, and in the modulation pulse generation step, the modulation pulses different in synchronizing phase are generated based on the motion amount detected in the motion detection step.

As described above, in the twenty-fifth aspect, the timing of emission of the light source is controlled based on the motion amount for each region of the screen, and thus the quality of the display screen can be optimally improved as a whole.

According to a twenty-sixth aspect based on the twenty-fifth aspect, the plurality of predetermined regions include at least a first predetermined region in which data based on the video signal is written at a time comparatively early in one frame and a second predetermined region in which data based on the video signal is written at a time comparatively late in one frame, and in the modulation pulse generation step, a first modulation pulse having a synchronizing phase permitting emission of the light source at a comparatively early time is generated when the motion amount in the first predetermined region detected by the motion detection means is greater than the motion amount in the second predetermined region, and a second modulation pulse having a synchronizing phase permitting emission of the light source at a comparatively late time is generated when the motion amount in the first predetermined region detected by the motion detection means is smaller than the motion amount in the second predetermined region.

As described above, in the twenty-sixth aspect, it is determined whether the region in which data is written at an early time or the region in which data is written at late timing has a large or small motion amount. For the region having a comparatively large motion amount, the synchronizing phase of the modulation pulse is changed so that the influence of contour blurring or coloring in a moving image is comparatively lessened. In this way, the quality of the display screen can be optimally improved as a whole.

According to a twenty-seventh aspect based on the twenty-sixth aspect, the modulation pulse generation step includes:

a count step of delaying a vertical synchronizing signal by a predetermined time according to the comparison result in the comparison step; and a pulse output step of outputting a pulse based on the vertical synchronizing signal delayed in the count step.

As described above, in the twenty-seventh aspect, by controlling the delay time of the vertical synchronizing signal, the synchronizing phase of the modulation pulse can be easily controlled.

According to a twenty-eighth aspect based on the twenty-sixth aspect, in the modulation pulse generation step, when an output pulse is changed with change of the motion amount for each of the plurality of predetermined regions detected in the motion detection step, the synchronizing phase of the output pulse is sequentially shifted stepwise by outputting a modulation pulse in a synchronizing phase somewhere between the synchronizing phase of the first modulation pulse and the synchronizing phase of the second modulation pulse.

As described above, in the twenty-eighth aspect, the synchronizing phase of the modulation pulse is changed by shifting stepwise, and this prevents occurrence of momentary change of luminance that may otherwise occur with abrupt change of the synchronizing phase of the modulation pulse.

According to a twenty-ninth aspect based on the twenty-first aspect, the method further includes a pulse width determination step of determining the pulse width of the modulation pulse based on the motion amount detected in the motion detection step, wherein in the modulation pulse generation step, the modulation pulse having the pulse width determined in the pulse width determination step is generated.

As described above, in the twenty-ninth aspect, the length of the lighting-up time of the light source is changed according to the motion amount, and thus the balance between the improvement of contour blurring in a moving image and the amount of light from the light source can be optimally controlled according to the motion amount.

According to a thirtieth aspect based on the twenty-ninth aspect, the pulse width determined in the pulse width determination step becomes smaller as the motion amount detected in the motion detection step is greater, and is greater as the motion amount is smaller.

As described above, in the thirtieth aspect, the pulse width of the modulation pulse is reduced when the motion amount is great, to improve on the problem of contour blurring and coloring in a moving image, and the modulation pulse width is increased when the motion amount is small, to ensure a sufficient amount of light from the light source.

According to a thirty-first aspect based on the twenty-ninth aspect, the method further includes:

a gain determination step of determining the gain of the video signal based on the motion amount detected in the motion detection step; and a gain control step of controlling the gain of the video signal according to the gain determined in the gain determination step.

As described above, in the thirty-first aspect, the change in luminance with change of the pulse width of the modulation pulse can be compensated for by correction of the video signal.

According to a thirty-second aspect based on the thirty-first aspect, the gain determined in the gain determination step is greater as the pulse width determined in the pulse width determination step is smaller, and becomes smaller as the pulse width is greater.

As described above, in the thirty-second aspect, the gain of the video signal is increased as the pulse width of the modulation pulse is reduced, and is reduced as the modulation pulse width is increased, and thus the change of the luminance can be suppressed.

According to a thirty-third aspect based on the twenty-first aspect, in the motion detection step, the motion amount is detected based on a data difference between two continuous frames.

As described above, in the thirty-third aspect, the motion amount of the display image can be easily detected from the video signal based on a data difference between two continuous frames.

According to a thirty-fourth aspect based on the twenty-first aspect, the light source is a fluorescent lamp.

As described above, in the thirty-fourth aspect, an inexpensive apparatus can be obtained by use of a fluorescent lamp as the light source. Also, by improving on the problem of degradation of the image quality during display of a moving image due to the persistent response characteristic of the fluorescent lamp, higher-quality image display can be realized.

According to a thirty-fifth aspect based on the twenty-first aspect, the passive light modulation device is a liquid crystal display.

As described above, in the thirty-fifth aspect, by use of a liquid crystal display as the passive light modulation device, an inexpensive apparatus can be obtained. Also, by reducing image contour blurring in a moving image, higher-quality image display can be realized.

According to a thirty-sixth aspect based on the twenty-first aspect, the passive light modulation device is a digital micromirror device (DMD) display.

As described above, in the thirty-sixth aspect, by use of a DMD display as the passive light modulation device, a high-quality image display apparatus can be realized. Also, by reducing image contour blurring for a moving image, an even higher-quality image display can be realized.

DETAILED DESCRIPTION OF THE INVENTION

Hereinafter, embodiments of the present invention will be described with reference to the accompanying drawings.

(First Embodiment)

Figure 1:
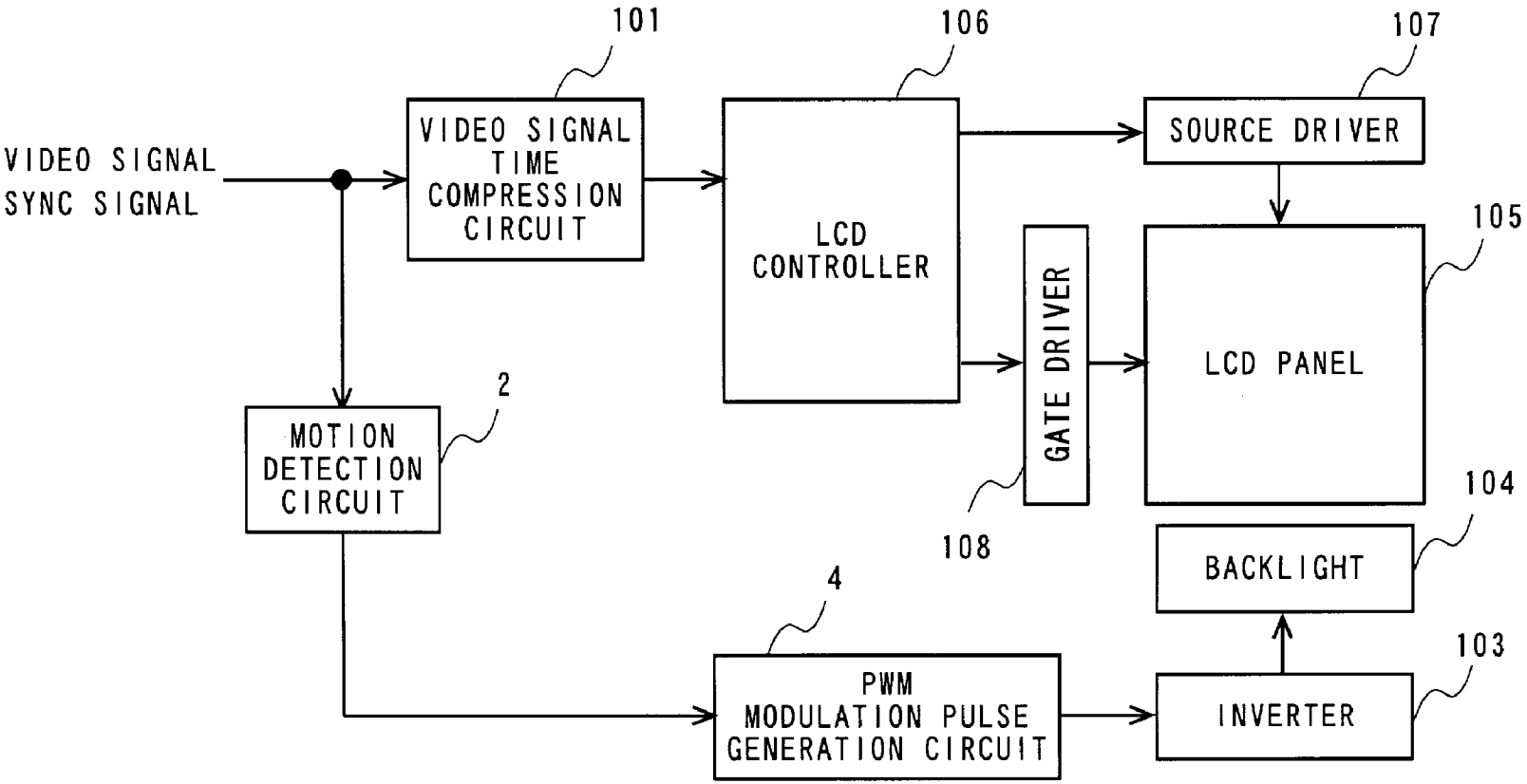
FIG. 1 is a block diagram of an image display apparatus of the first embodiment of the present invention.
Figure 14:
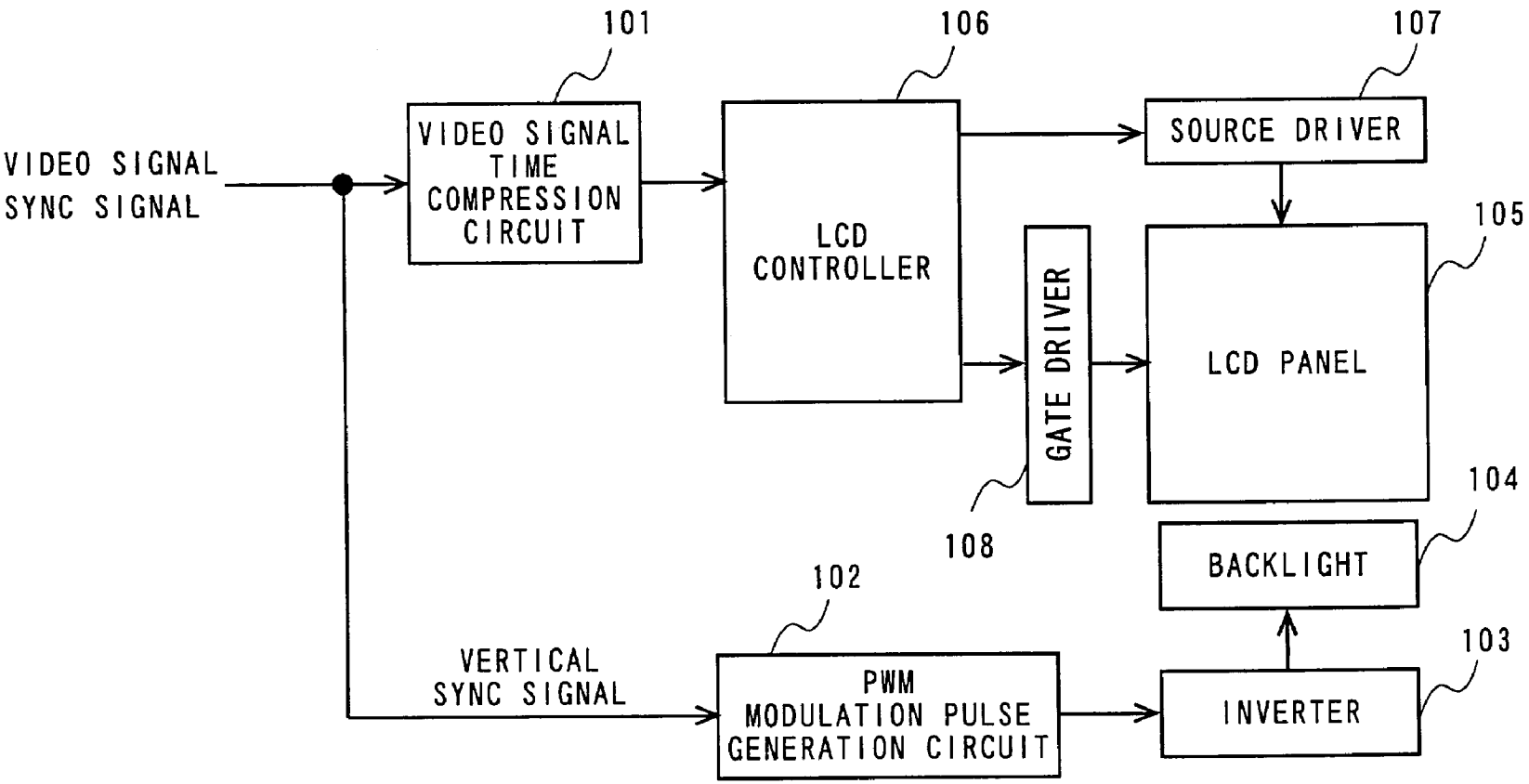
FIG. 14 is a block diagram of a conventional image display apparatus.

FIG. 1 illustrates a configuration of an image display apparatus of the first embodiment of the present invention. The image display apparatus includes a video signal time compression circuit 101, a motion detection circuit 2, a PWM modulation pulse generation circuit 4, an inverter 103, a backlight 104, a liquid crystal panel 105, an LCD controller 106, a source driver 107 and a gate driver 108. The same components as those of the conventional apparatus shown in FIG. 14 are denoted by the same reference numerals, and the detailed descriptions thereof are omitted here.

Figure 2:
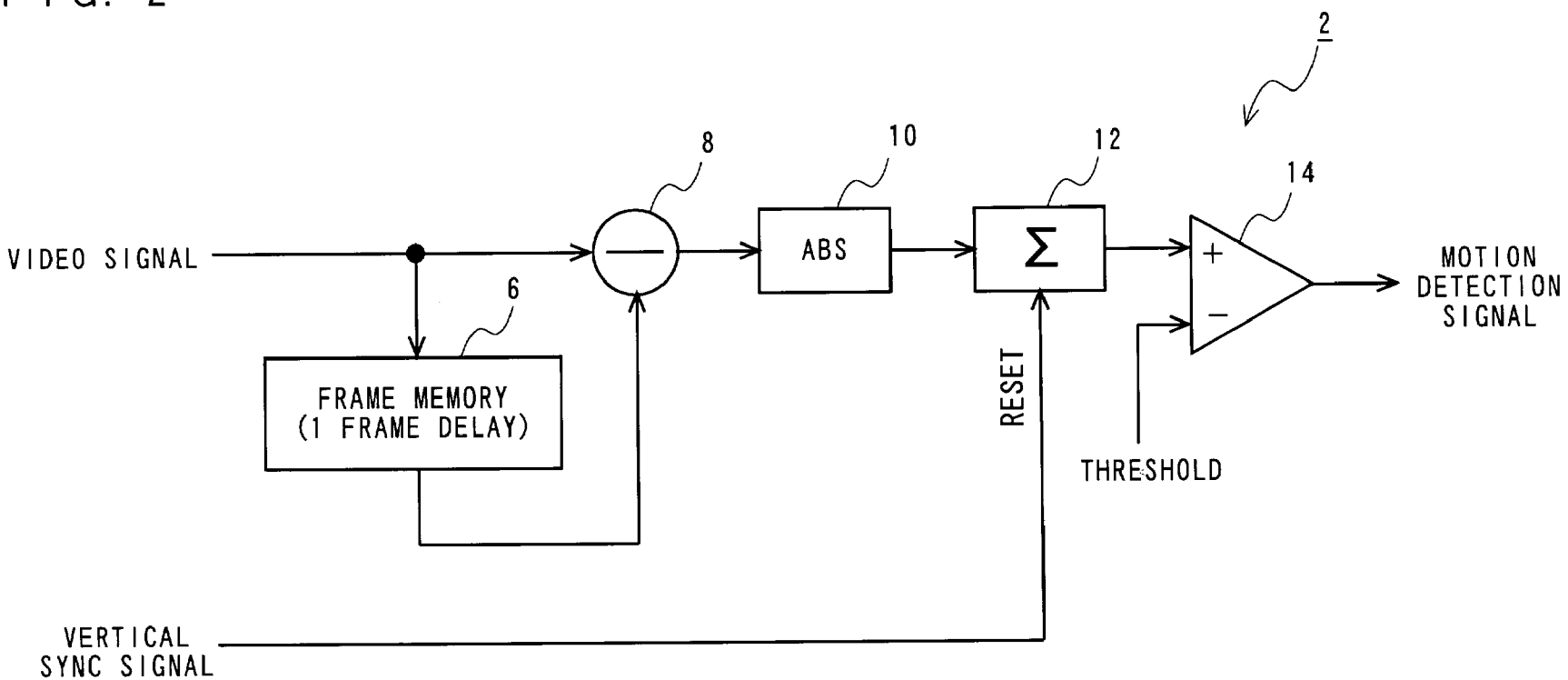
FIG. 2 is a block diagram of a motion detection circuit 2.

FIG. 2 illustrates a configuration of the motion detection circuit 2. A video signal and a synchronizing signal are supplied to the motion detection circuit 2. The motion detection circuit 2 includes: a frame memory 6 for delaying the video signal by one frame; a subtracter 8 for computing the one-frame difference from the video signal and the output of the frame memory 6; an absolute circuit (ABS) 10 for computing the absolute of the output of the subtracter 8; an accumulator 12 for accumulating the output of the absolute circuit 10 for one frame based on the vertical synchronizing signal; and a comparator 14 for comparing the amount of motion of a display image as the output of the accumulator 12 with a predetermined threshold and outputting the comparison result as a motion detection signal.

The motion detection circuit 2 calculates the motion amount based on the difference between two continuous frames for each pixel. More specifically, the subtracter 8 outputs the difference between data in one pixel in one frame and data in the same pixel in the immediately previous frame for each pixel, and the absolute circuit 10 outputs the absolute of the difference for each pixel. By this operation, the degree of correlation between the frames is obtained for each pixel. The accumulator 12 accumulates the correlation of each pixel for one frame, to obtain the degree of inter-frame correlation as the average of the entire screen. Whether the display image is an image with large motion (hereinafter, simply called a moving image) or an image with small motion (hereinafter, simply called a still image) is determined depending on whether the output of the accumulator 12 is greater or smaller than a predetermined value. The result is outputted as the motion detection signal. For example, "0" is outputted in the case of a moving image, and "1" is outputted in the case of a still image.

Figure 3:
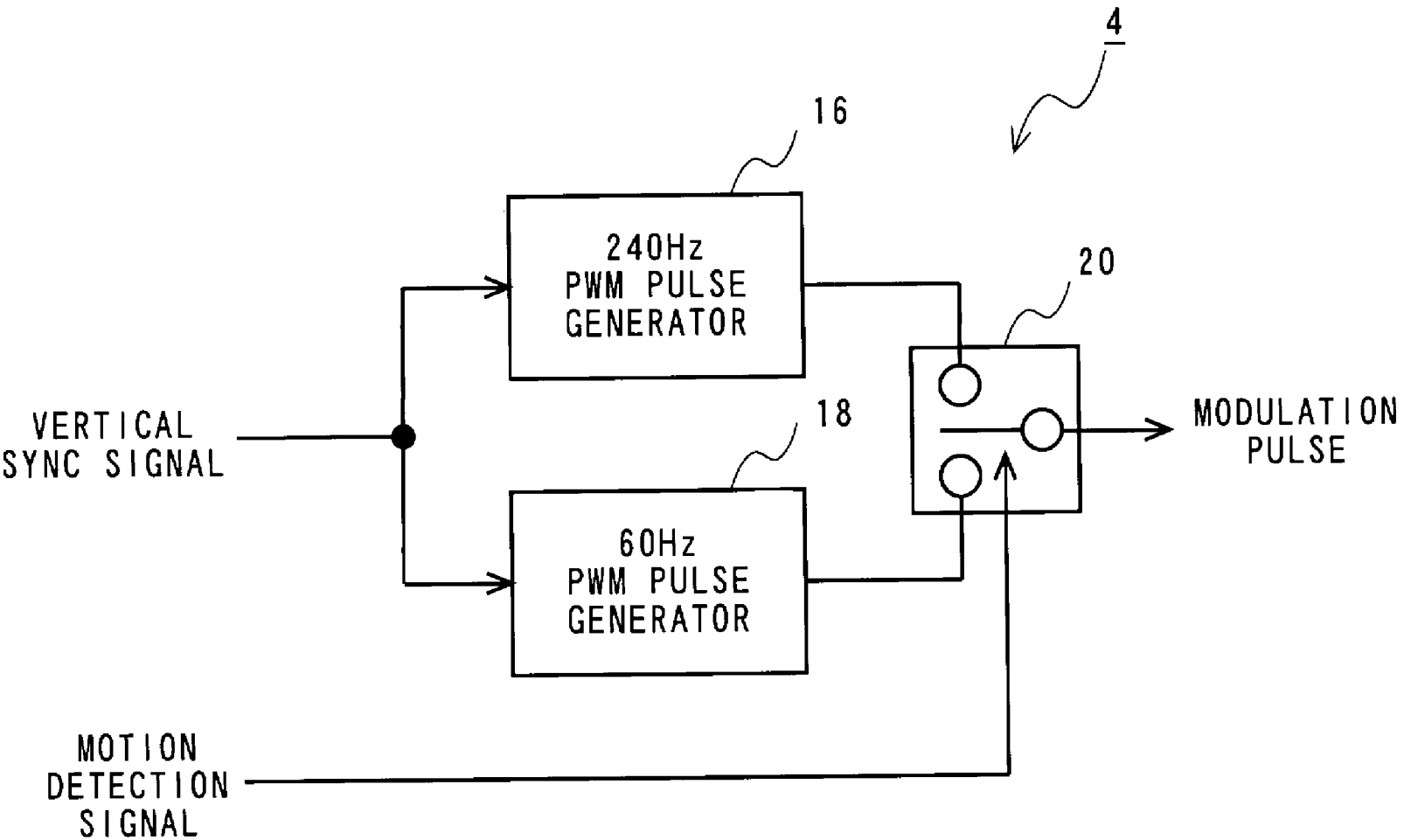
FIG. 3 is a block diagram of a PWM modulation pulse generation circuit 4.

FIG. 3 illustrates a configuration of the PWM modulation pulse generation circuit 4. The motion detection signal from the motion detection circuit 2 and the vertical synchronizing signal are supplied to the PWM modulation pulse generation circuit 4. The PWM modulation pulse generation circuit 4 includes: a 240 Hz PWM pulse generator 16 for generating a 240 Hz PWM modulation pulse synchronizing with the vertical synchronizing signal; a 60 Hz PWM pulse generator 18 for generating a 60 Hz PWM modulation pulse synchronizing with the vertical synchronizing signal; and a selector 20 for switching between the output of the 240 Hz PWM pulse generator 16 and the output of the 60 Hz PWM pulse generator 18 based on the result of the motion detection by the motion detection circuit 2 and outputting the selected pulse as the modulation pulse.

Figure 4:
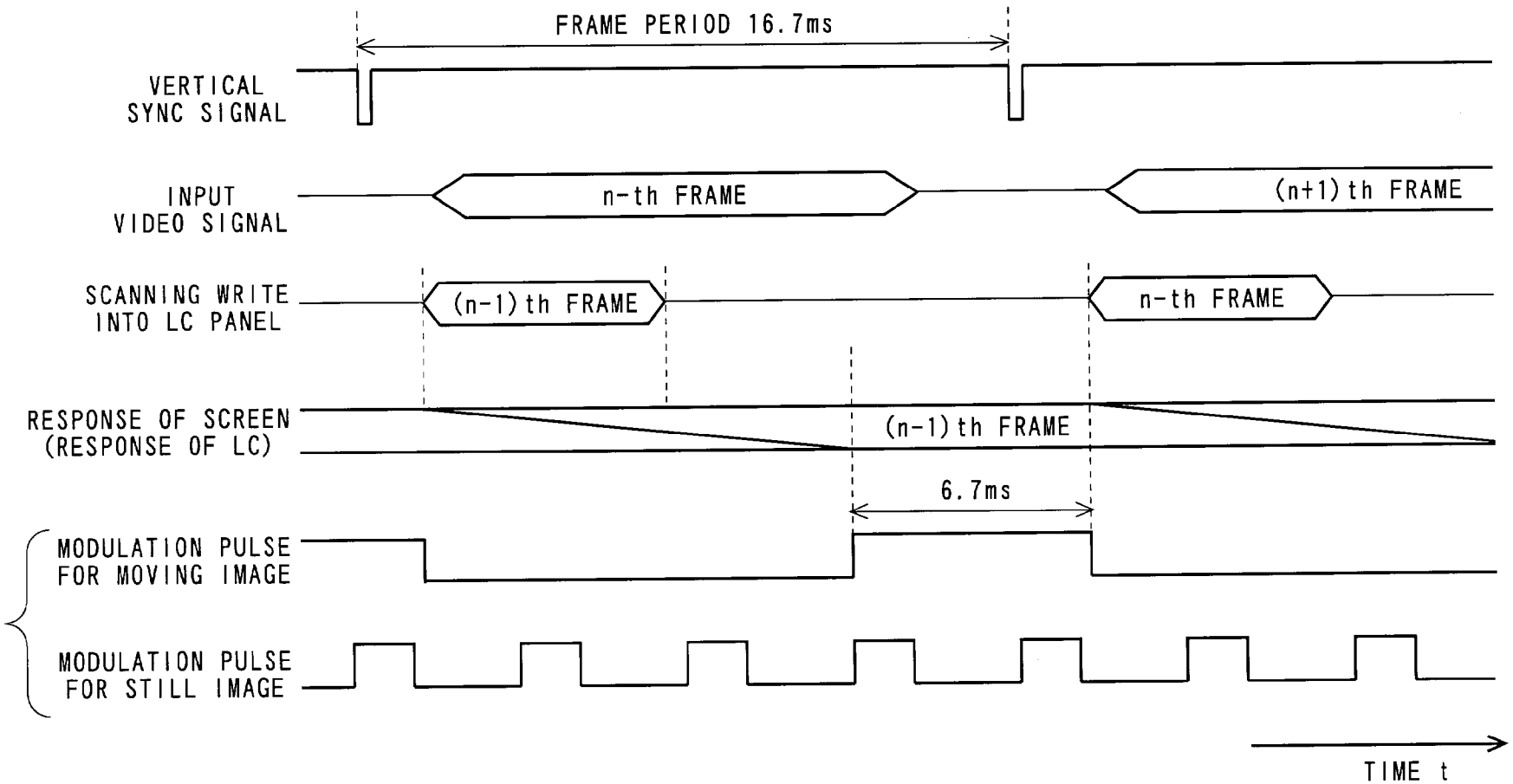
FIG. 4 is a view showing the operation timing in the first embodiment.
Figure 15:
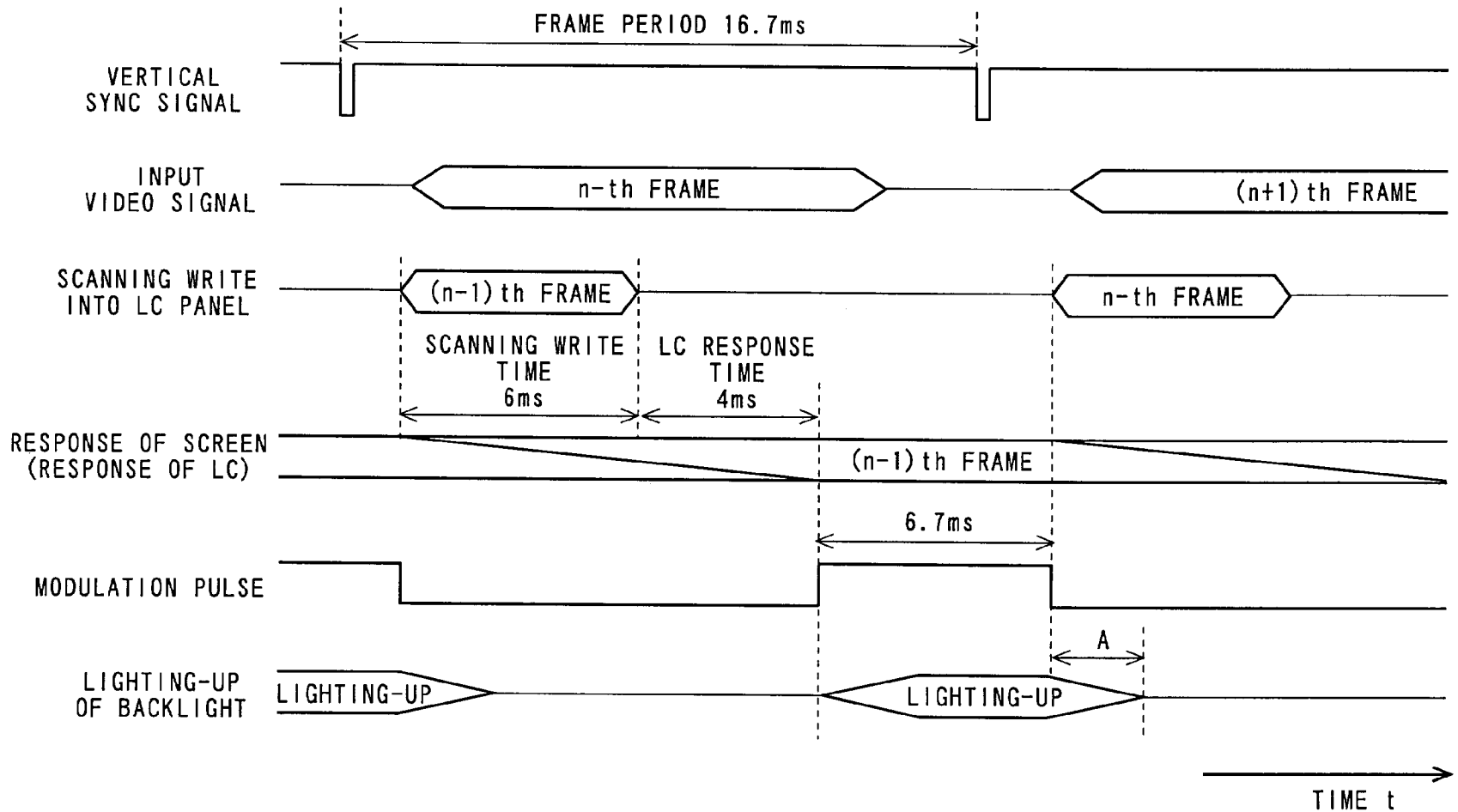
FIG. 15 is a view showing the operation timing of the conventional image display apparatus.
Figure 16:
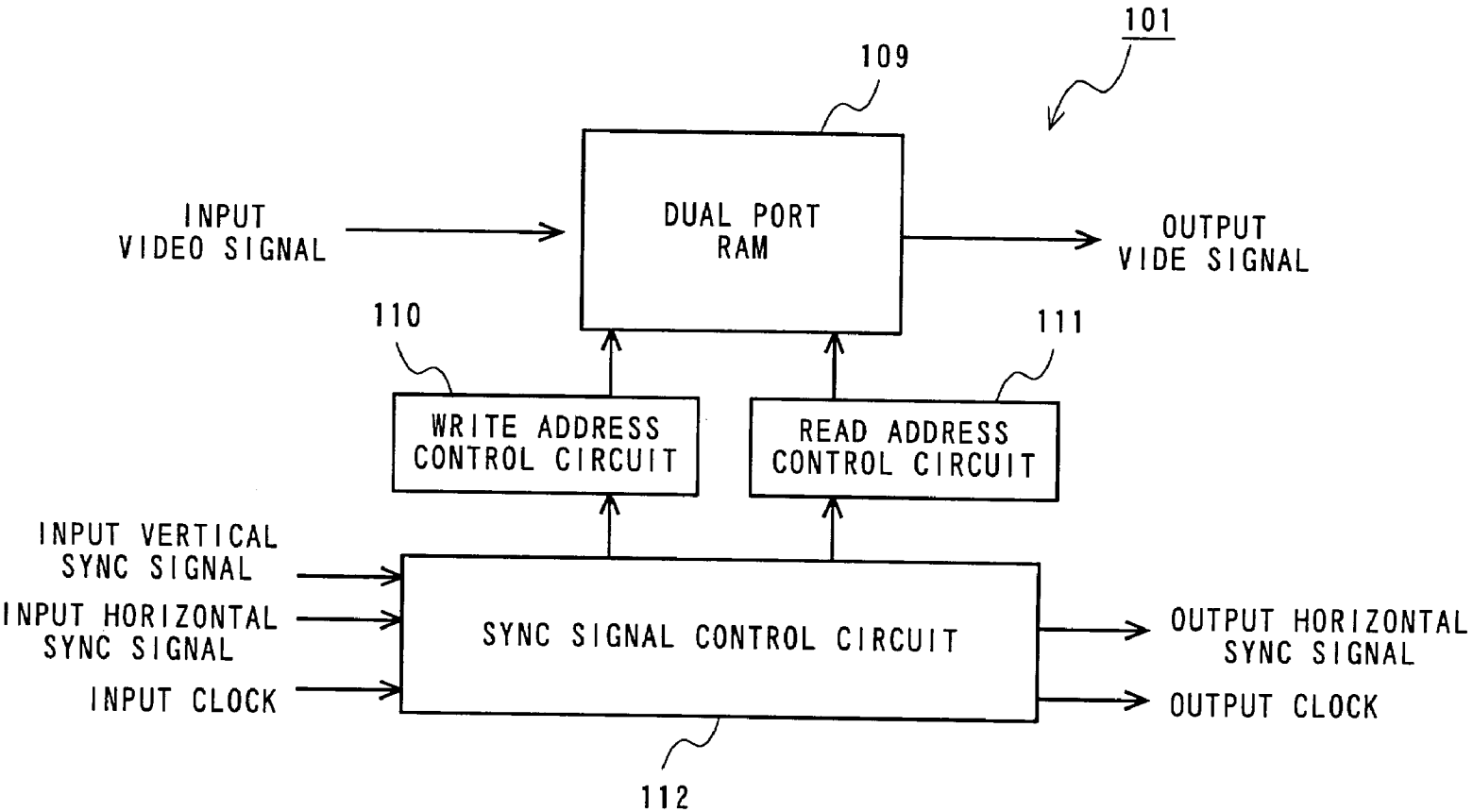
FIG. 16 is a block diagram of a video signal time compression circuit 101.
Figure 17:
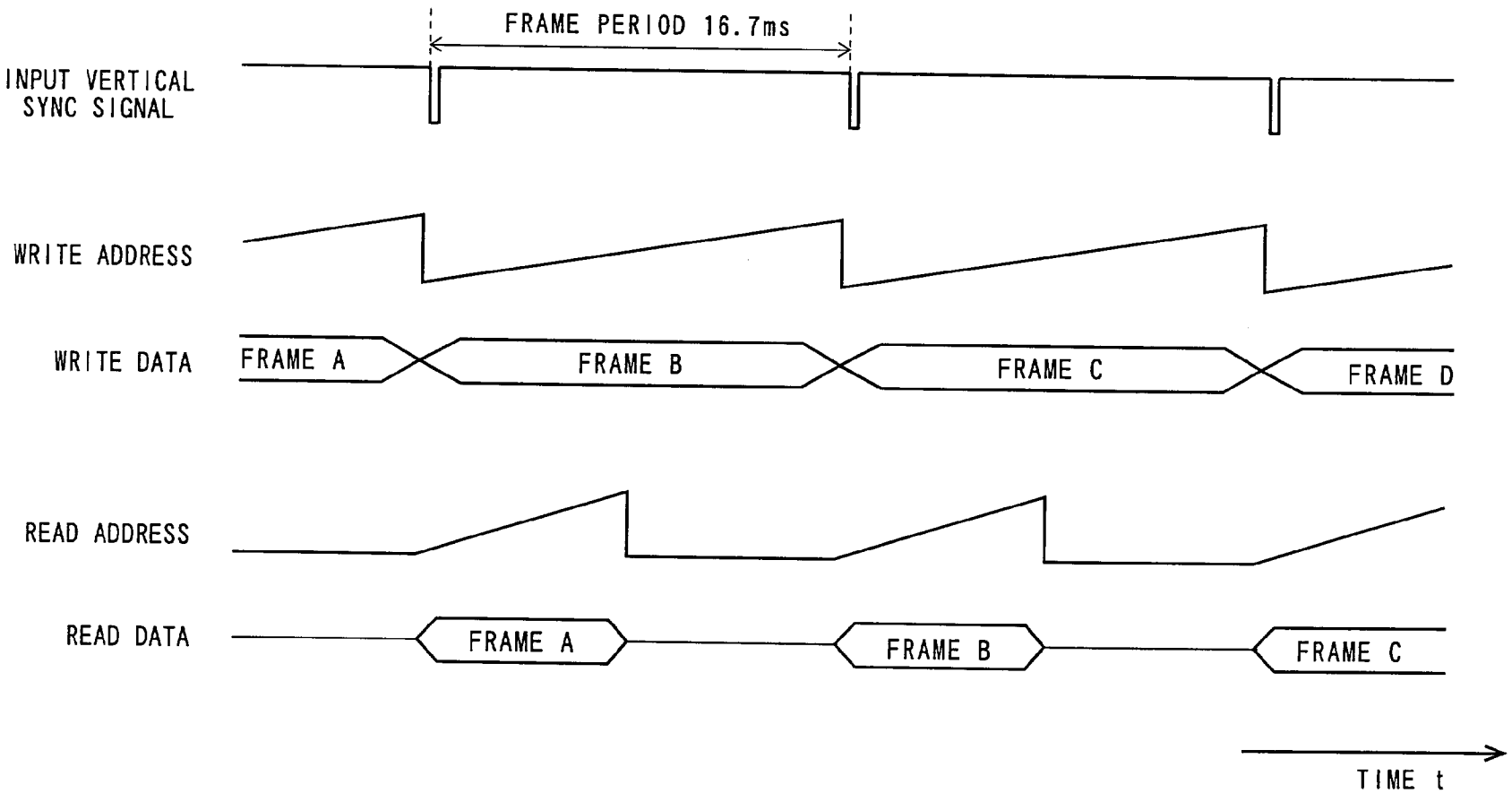
FIG. 17 is a view showing the operation timing of the video signal time compression circuit 101.
Figure 18:
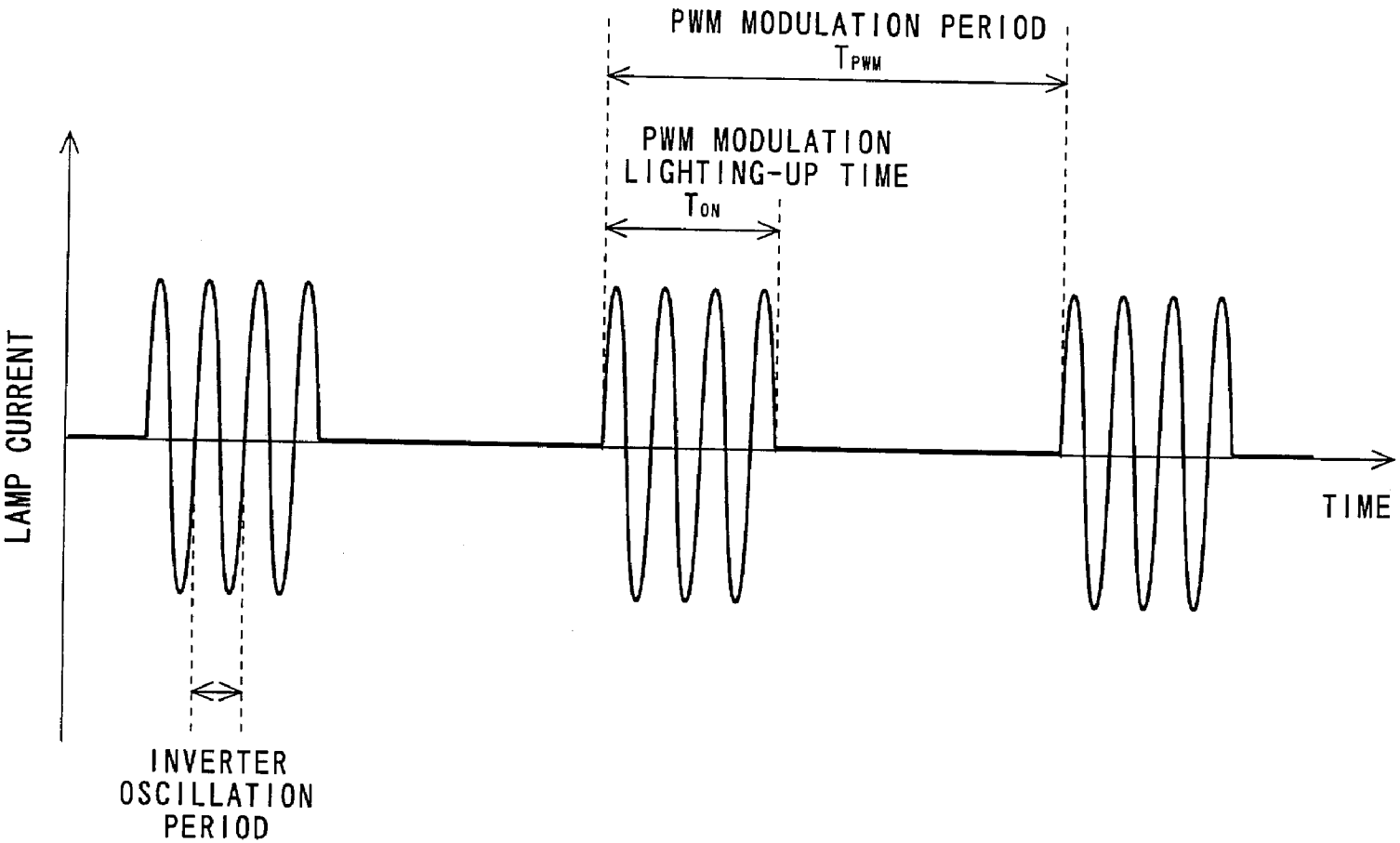
FIG. 18 PRIOR ART
FIG. 18 is a view showing the oscillation waveform of an inverter 103.
Figure 19:
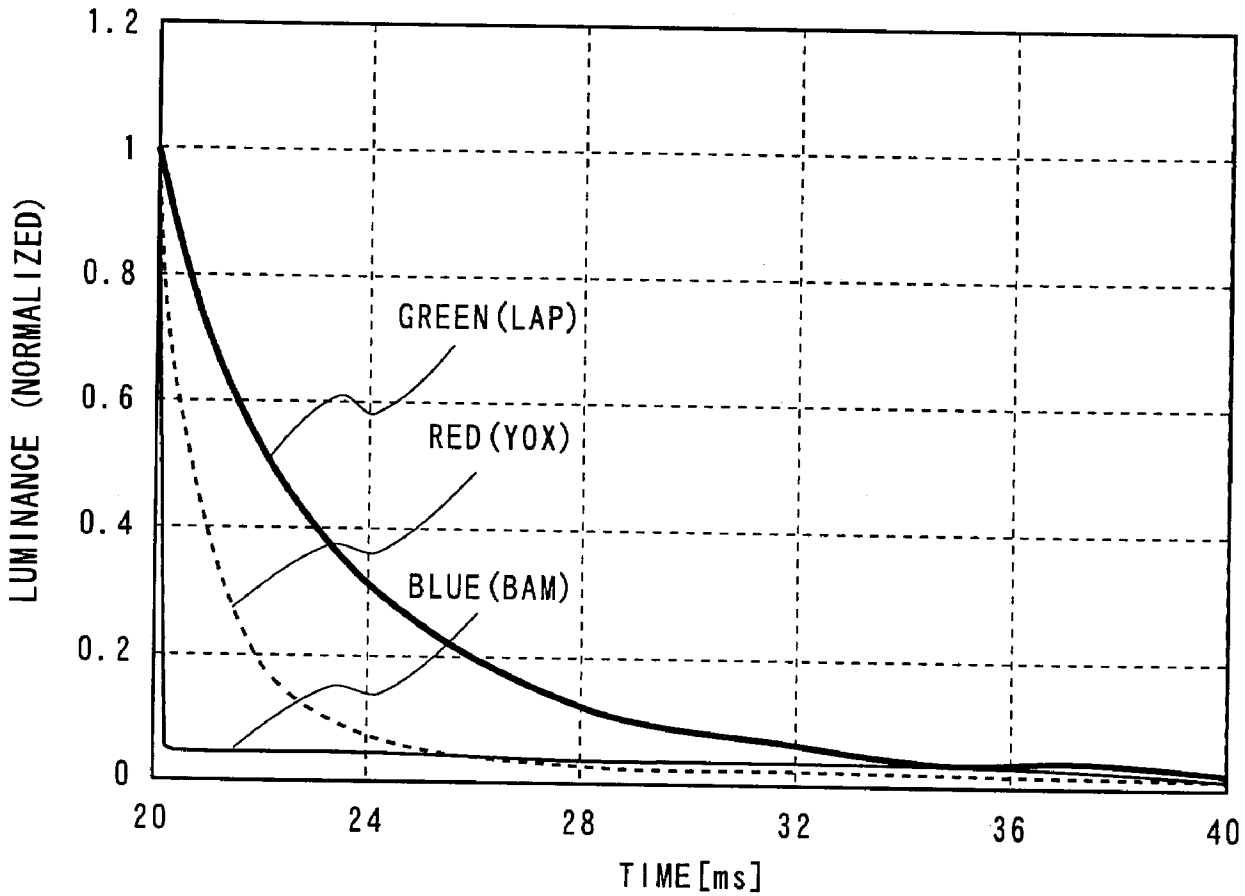
FIG. 19 PRIOR ART
FIG. 19 is a view showing the persistent response characteristics of phosphors.

The PWM modulation pulse generation circuit 4 generates the modulation pulse having a predetermined period based on the motion detection result from the motion detection circuit 2. When the motion detection circuit 2 determines that the display image is a moving image, the selector 20 selects and outputs the modulation pulse from the 60 Hz PWM pulse generator 18. When the motion detection circuit 2 determines that the display image is a still image, the selector 20 selects and outputs the modulation pulse from the 240 Hz PWM pulse generator 16. These outputted modulation pulses have the waveforms shown in FIG. 4. Note that the width and phase of the pulse generated by the 60 Hz PWM pulse generator 18 are the same as those of the modulation pulse used in the conventional apparatus shown in FIG. 15.

The 240 Hz PWM modulation is not perceived as flicker by the human eyes. Therefore, no flicker is generated during display of a still image.

The PWM pulse duty is 39% for both the 240 Hz PWM pulse generator 16 and the 60 Hz PWM pulse generator 18. The 240 Hz PWM pulse generator 16 and the 60 Hz PWM pulse generator 18 do not necessarily have the same PWM pulse duty, but preferably do have such because, by having the same PWM pulse duty, the screen luminance is prevented from changing during the switching between a moving image and a still image. Note, however, that the PWM pulse duty with which the same luminance is obtained may differ a little between the two generators due to the characteristics of the inverter and the cold-cathode tube.

In this embodiment, the frequency of the modulation pulse during the display of a still image was set at 240 Hz. It is needless to mention that any frequency high enough to make flicker unobtrusive may also be used.

As described above, in the first embodiment, motion blurring can be improved during display of a moving image, and also flicker can be reduced during display of a still image.

(Second Embodiment)

Figure 5:
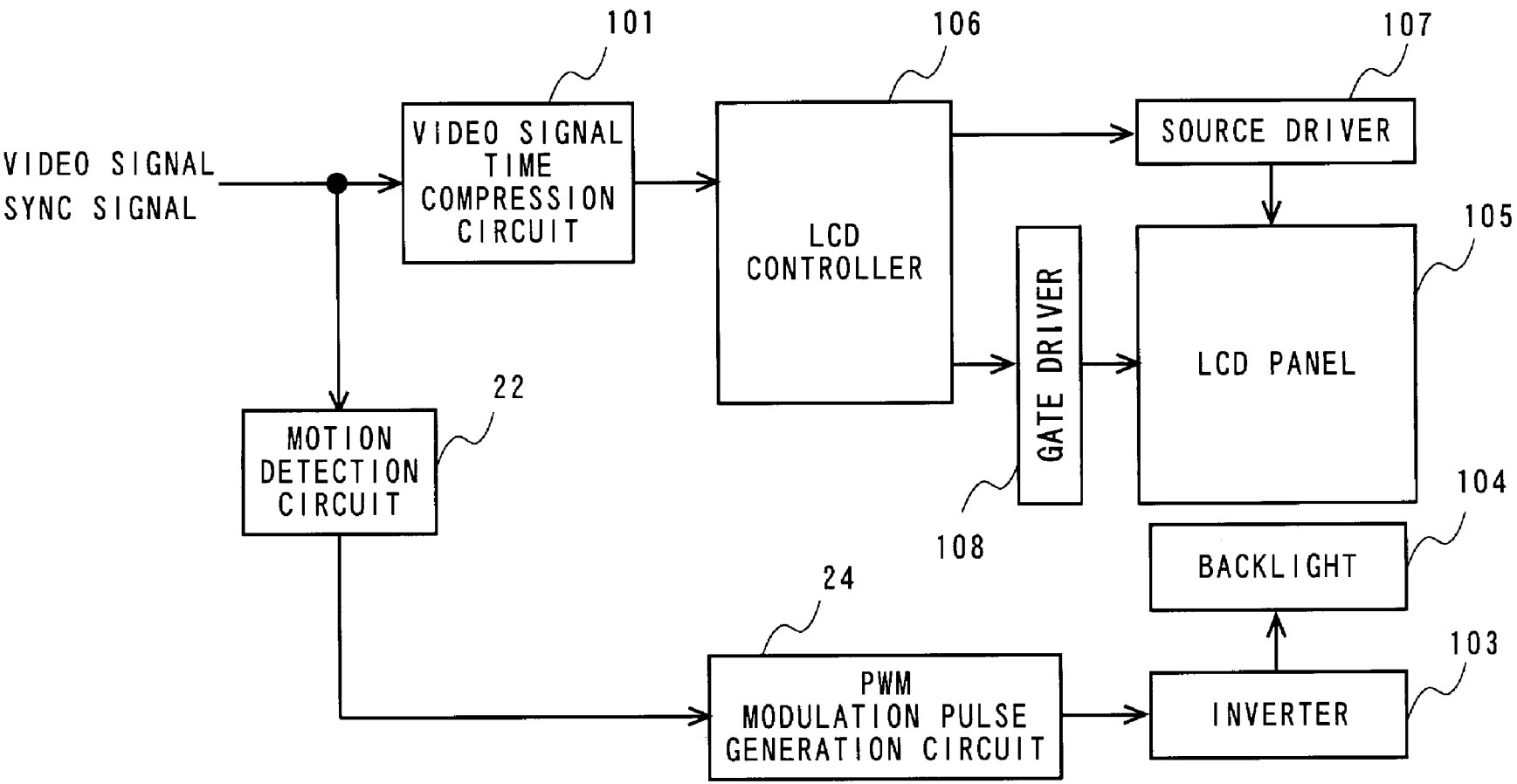
FIG. 5 is a block diagram of an image display apparatus of the second embodiment of the present invention.

FIG. 5 illustrates a configuration of an image display apparatus of the second embodiment of the present invention. The image display apparatus includes a video signal time compression circuit 101, a motion detection circuit 22, a PWM modulation pulse generation circuit 24, an inverter 103, a backlight 104, a liquid crystal panel 105, an LCD controller 106, a source driver 107 and a gate driver 108. In FIG. 5, the same components as those of the conventional apparatus shown in FIG. 14 are denoted by the same reference numerals, and the descriptions thereof are omitted here.

Figure 6:
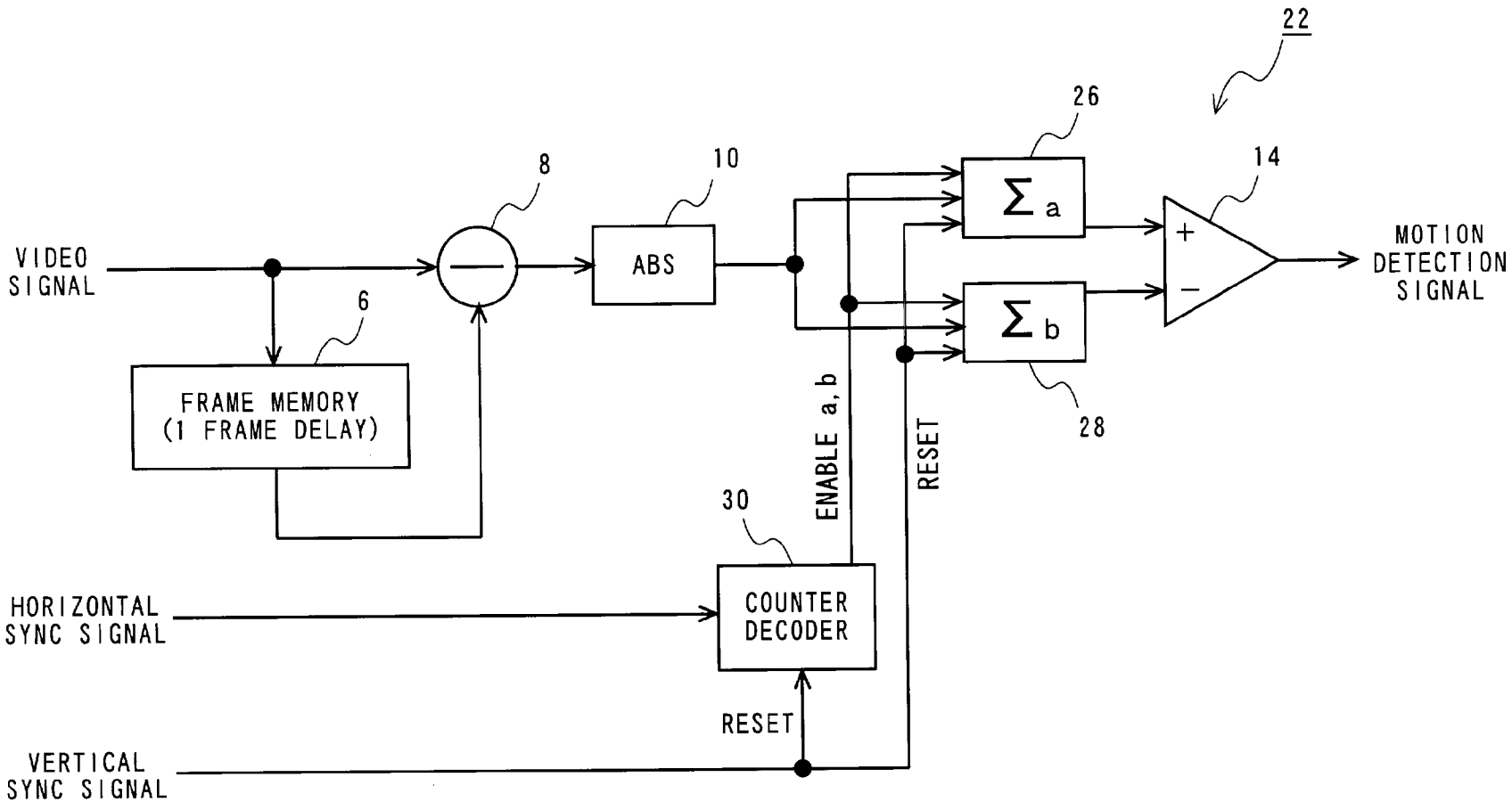
FIG. 6 is a block diagram of a motion detection circuit 22.

FIG. 6 illustrates a configuration of the motion detection circuit 22. The motion detection circuit 22 receives a video signal and a synchronizing signal. The motion detection circuit 22 includes: a frame memory 6; a subtracter 8; an absolute circuit 10; a counter decoder 30 for outputting enable pulses ENABLE_a and ENABLE_b based on the synchronizing signal; an accumulator 26 for accumulating the output of the absolute circuit 10 for each frame only for the time period during which the enable pulse ENABLE_a is true; an accumulator 28 for accumulating the output of the absolute circuit 10 for each frame only for the time period during which the enable pulse ENABLE_b is true; and a comparator 14 for comparing the outputs of the accumulators 26 and 28 and outputting the comparison result as a motion detection signal. In FIG. 6, the same components as those shown in FIG. 2 are denoted by the same reference numerals, and the descriptions thereof are omitted here.

Figure 7:
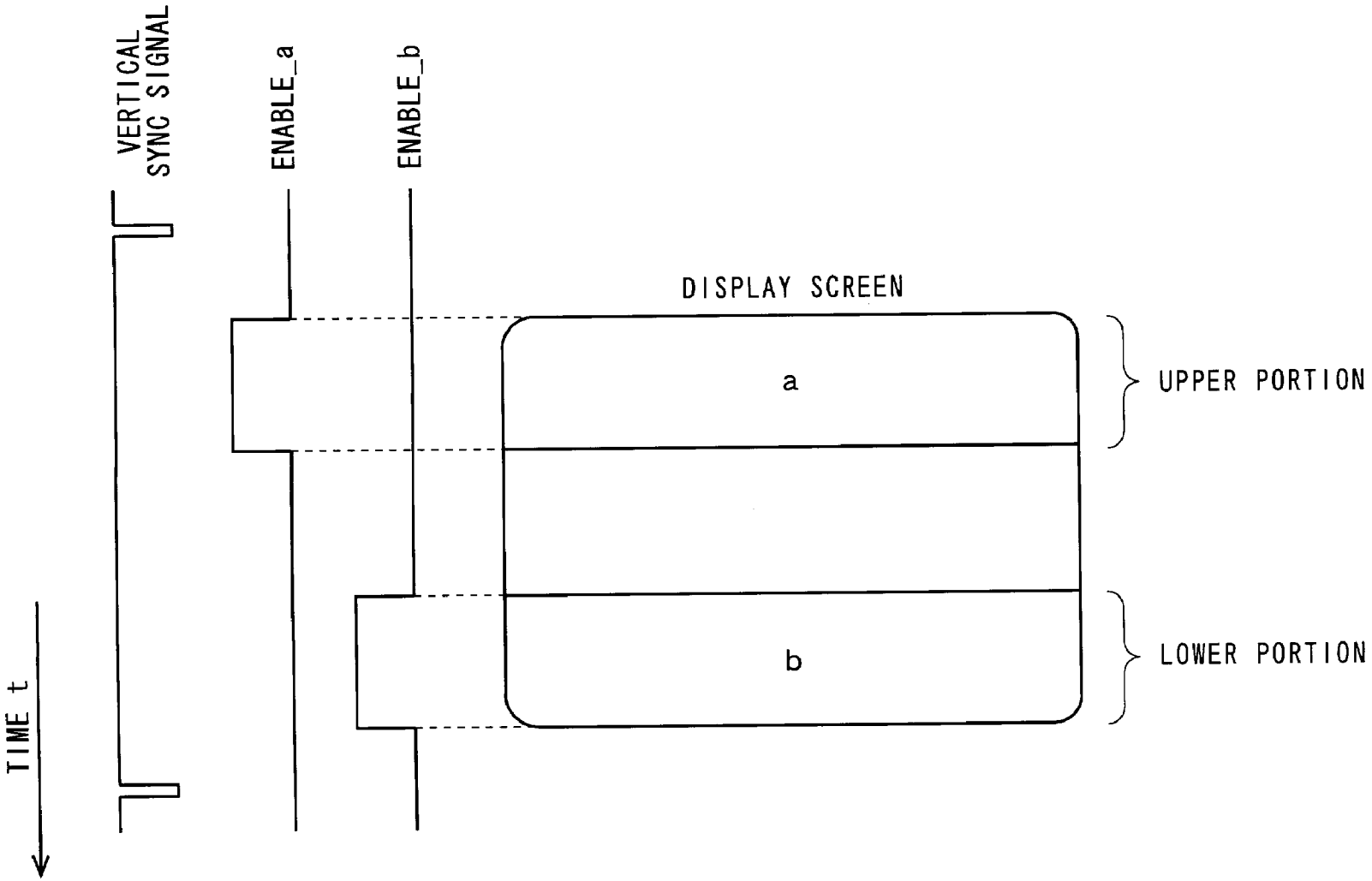
FIG. 7 is a view showing the operation timing of a counter decoder 30.

Referring to FIG. 7, the operation of the counter decoder 30 will be described. The counter decoder 30 generates the enable pulses ENABLE_a and ENABLE_b, which respectively correspond to the upper portion and the lower portion of a screen, based on the vertical synchronizing signal and the horizontal synchronizing signal. The accumulator 26 detects the motion amount based on the video signal for the upper portion of the screen, while the accumulator 28 detects the motion amount based on the video signal for the lower portion of the screen. The comparator 14 compares the motion amount in the upper portion of the screen with the motion amount in the lower portion of the screen based on the outputs of the accumulators 26 and 28, and outputs the result as the motion detection signal.

Figure 8:
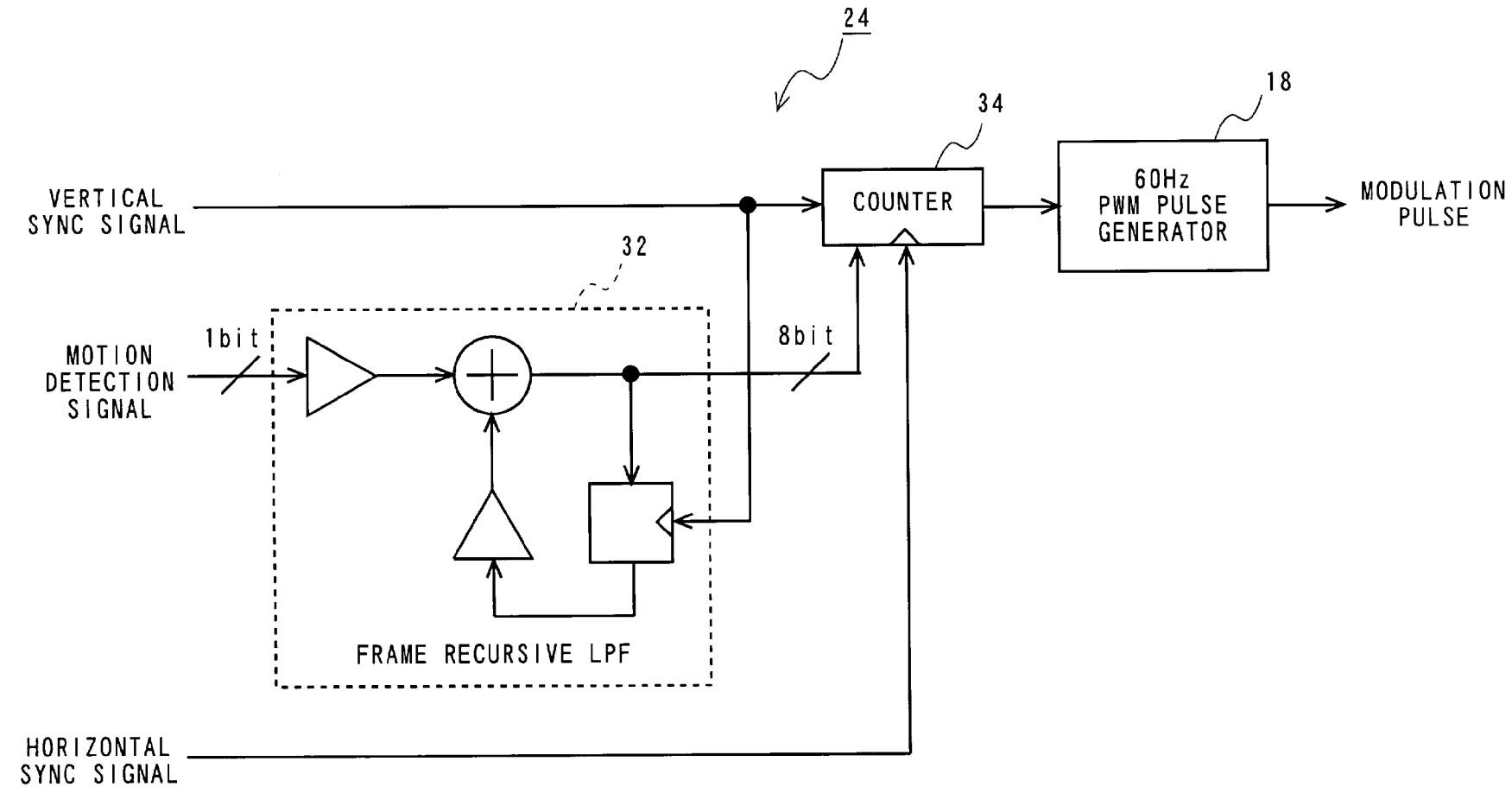
FIG. 8 is a block diagram of a PWM modulation pulse generation circuit 24.

FIG. 8 illustrates a configuration of the PWM modulation pulse generation circuit 24. The motion detection signal from the motion detection circuit 22 and the vertical synchronizing signal are supplied to the PWM modulation pulse generation circuit 24. The PWM modulation pulse generation circuit 24 includes: a frame recursive low-pass filter 32 for outputting motion position data based on the motion detection signal; a counter 34 for outputting a pulse obtained by delaying the vertical synchronizing signal by a predetermined time based on the motion position data; and a 60 Hz PWM pulse generator 18 for outputting a modulation pulse synchronizing with the vertical synchronizing signal by being triggered with the output of the counter 34. In FIG. 8, the same components as those in FIG. 3 are denoted by the same reference numerals, and the detailed descriptions thereof are omitted here.

Figure 9:
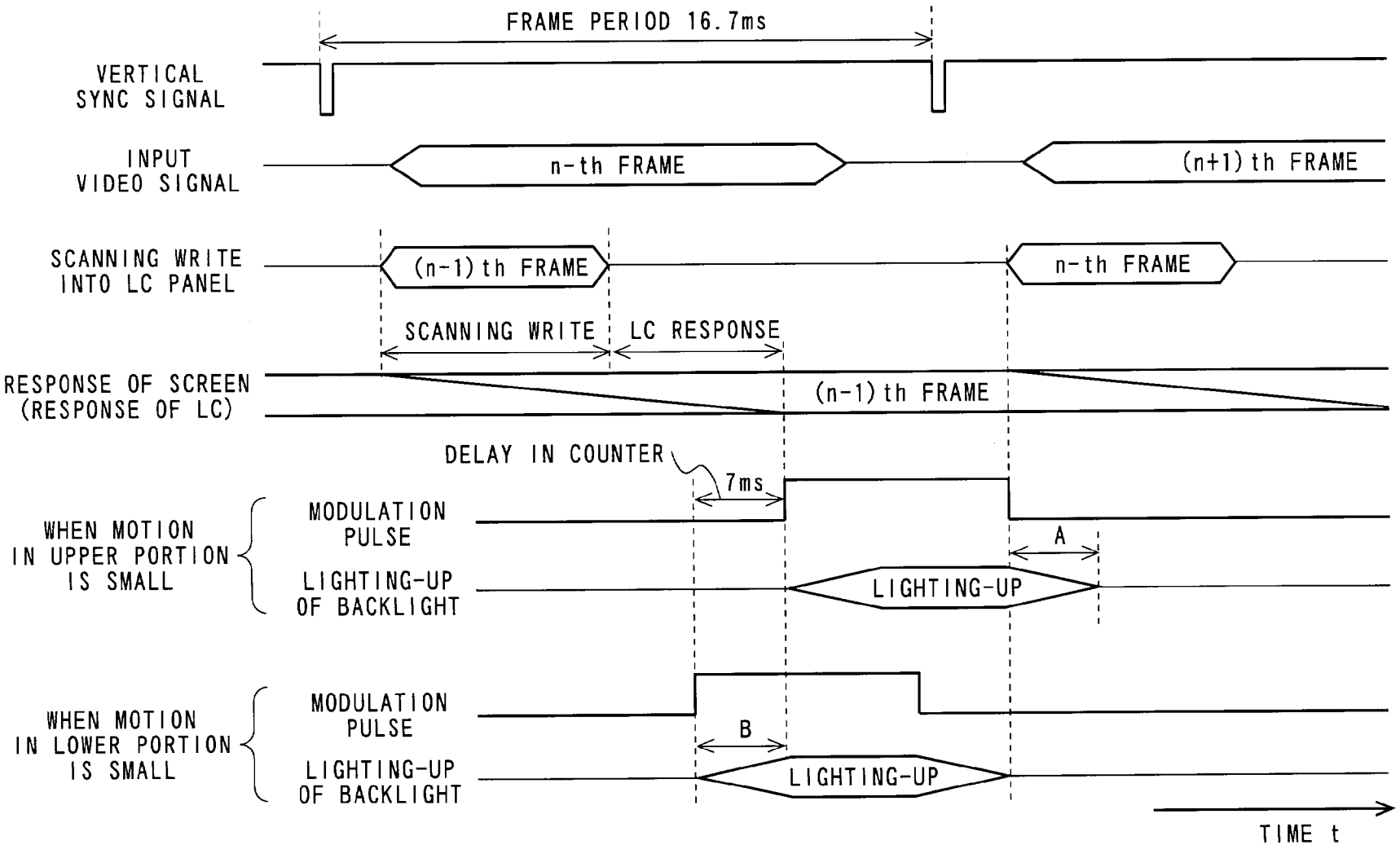
FIG. 9 is a view showing the operation timing in the second embodiment.

The PWM modulation pulse generation circuit 24 controls the timing of lighting up of the backlight 104 based on the motion detection signal. More specifically, as shown in FIG. 9, the backlight 104 is lit up with timing similar to that of the conventional apparatus shown in FIG. 15 when the motion is small in the upper portion of the screen. On the contrary, when the motion is small in the lower portion of the screen, the backlight 104 is lit up at a time earlier than that adopted when the motion is small in the upper portion. This control of the lighting-up timing of the backlight 104 is realized by delaying the vertical synchronizing signal in the counter 34 based on the motion detection signal.

As shown in FIG. 9, the delay in the counter 35 is about 7 ms when the motion is small in the upper portion of the screen, and thus the persistent response of the backlight overlaps with the write into the liquid crystal panel and the response of the liquid crystal in the upper portion of the screen. However, with small motion in the upper portion of the screen, the problem of contour blurring and coloring is reduced. The delay in the counter 35 is about 0 ms when the motion is small in the lower portion of the screen, and thus the persistent response of the backlight overlaps with the response of the liquid crystal in the lower portion of the screen. However, with small motion in the lower portion of the screen, the problem of contour blurring and coloring is reduced.

In this embodiment, although not requisite, the delay amount in the counter 34 is controlled stepwise in 256-level gray scale in correspondence with the 8-bit motion position data, which is outputted from the frame recursive low-pass filter 32 based on the 1-bit motion detection signal. For example, when the frequency of the horizontal synchronizing signal is 31.5 kHz, the delay amount of the vertical synchronizing signal is controlled stepwise in stages of every 32 $\mu$s in the range of 0 ms to 8 ms. The motion position data increases or decreases by one per frame according to the value of the motion detection signal. If the phase of the modulation pulse changes abruptly, the modulation pulse may momentarily become dense or sparse, which may disadvantageously be perceived as a momentary change of luminance. To ensure prevention of this disadvantage, the phase of the modulation pulse is preferably changed gradually as in this embodiment.

In this embodiment, the scanning was made from the top to the bottom of the screen. It is needless to mention that the present invention is also easily applicable to other ways of scanning, such as scanning from the bottom to the top of the screen.

As described above, in this embodiment, the lighting-up timing of the backlight is appropriately changed so that the response of the backlight corresponds to the small-motion portion of the display screen. By this operation, occurrence of the problem of blurring and coloring of a moving contour can be suppressed.

In this embodiment, the motion detection was performed only for two regions, the upper and lower portions of the screen. The number of divided regions of the screen may be increased to enhance the precision of the detection. Moreover, the center portion of the screen may also be detected, and the control range of the delay time in the counter 34 may be widened, to deal with the case that the motion is small in the center portion of the screen.

(Third Embodiment)

Figure 10:
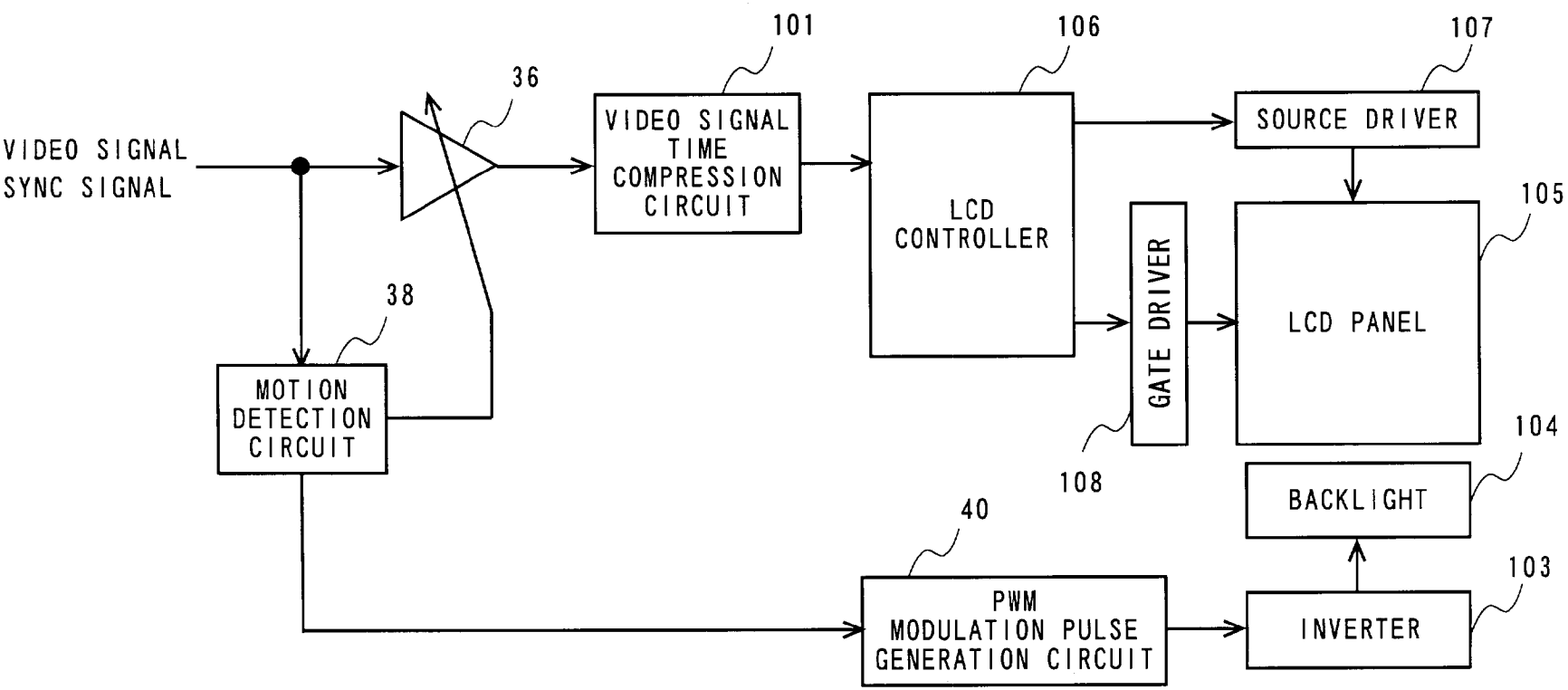
FIG. 10 is a block diagram of an image display apparatus of the third embodiment of the present invention.

FIG. 10 illustrates a configuration of an image display apparatus of the third embodiment of the present invention. The image display apparatus includes: a gain control circuit 36 for controlling the gain of a video signal based on video signal gain control data; a video signal time compression circuit 101, a motion detection circuit 38 for outputting the video signal gain control data and modulation pulse width control data based on the video signal; a PWM modulation pulse generation circuit 40 for outputting a symptom pulse based on the modulation pulse width control data; an inverter 103: a backlight 104; a liquid crystal panel 105; an LCD controller 106; a source driver 107; and a gate driver 108. In FIG. 10, the same components as those of the conventional apparatus shown in FIG. 14 are denoted by the same reference numerals, and the descriptions thereof are omitted here.

Figure 11:
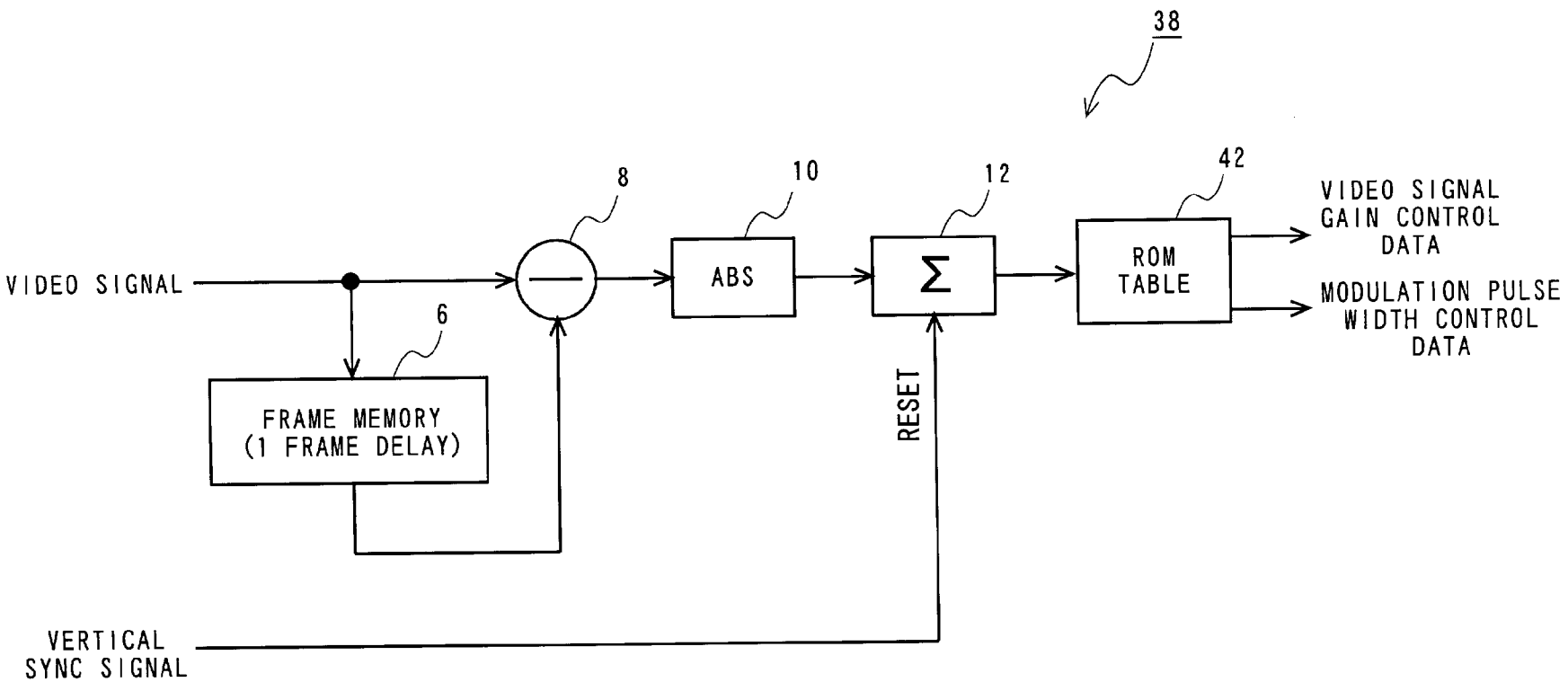
FIG. 11 is a block diagram of a motion detection circuit 38.

FIG. 11 illustrates a configuration of the motion detection circuit 38. The video signal and a synchronizing signal are supplied to the motion detection circuit 38. The motion detection circuit 38 includes: a frame memory 6; a subtracter 8; an absolute circuit 10; an accumulator 12; and a ROM table 42 for outputting the video signal gain control data and the modulation pulse width control data based on the output of the accumulator 12. In FIG. 11, the same components as those shown in FIG. 2 are denoted by the same reference numerals, and the descriptions thereof are omitted here.

Figure 12:
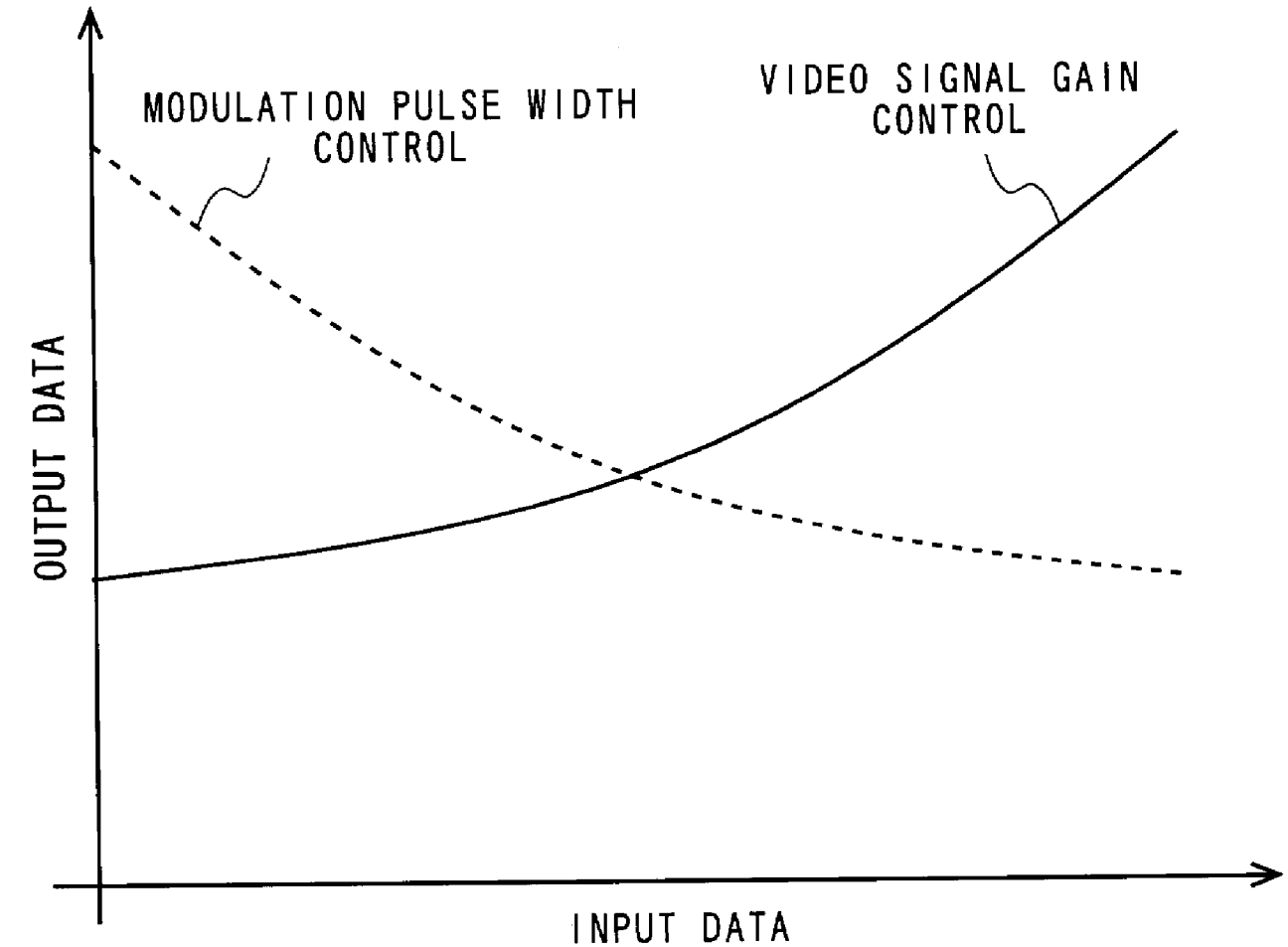
FIG. 12 is a view showing the input/output characteristics of a ROM table 42.

The input/output characteristics of the ROM table 42 will be described with reference to FIG. 12. The output of the accumulator 12 is inputted to the ROM table 42 as input data. The output of the accumulator 12 indicates how large the motion of an image is as described above. The ROM table 42 determines the video signal gain control data and the modulation pulse width control data according to the input data and outputs the data as the output data. The relationship between the input data and the output data is as shown in FIG. 12, in which as the value of the input data is greater, that is, as the motion is larger, the modulation pulse width control data is smaller and the video signal gain control data is greater.

Figure 13:
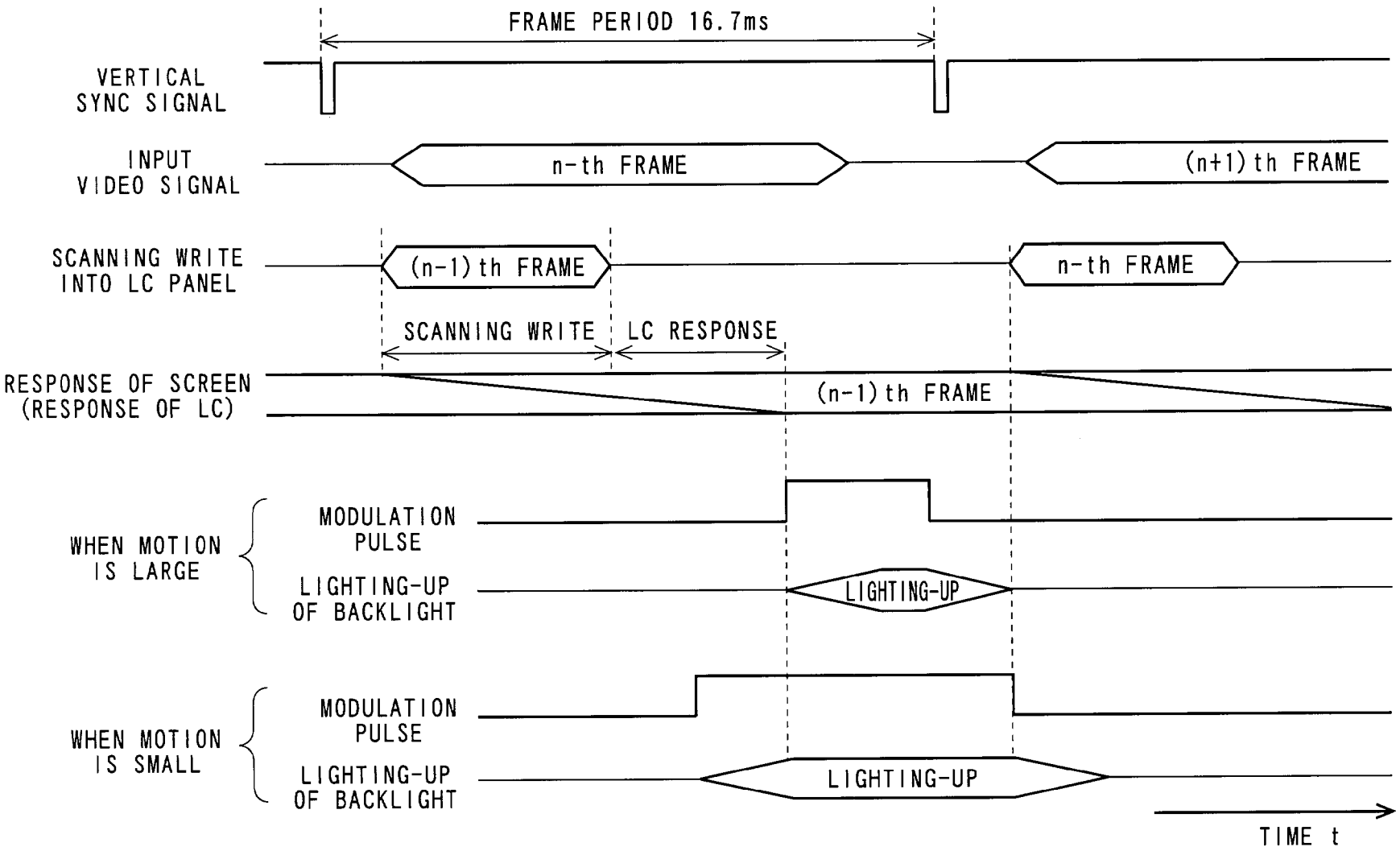
FIG. 13 is a view showing the operation timing in the third embodiment.

The PWM modulation pulse generation circuit 40 controls the lighting-up of the backlight 104 based on the modulation pulse width control data. More specifically, as shown in FIG. 13, the lighting-up of the backlight 104 is controlled so that as the motion of the display image is larger, the lighting-up time of the backlight including its persistence time overlaps less with the response time of the screen. With this control, it is possible to improve on the problem of contour blurring and coloring generated during display of a large-motion image.

The luminance will decrease if the modulation pulse width is made small to shorten the lighting-up time of the backlight 104, failing to obtain sufficient brightness. In this embodiment, to compensate for the decrease of the luminance, correction is made so that the video signal gain control data is greater as the modulation pulse width is smaller to thereby increase the luminance level of the video signal. In this correction, the image quality may be degraded due to signal saturation in a white peak portion of the video signal. Moreover, since an actually used liquid crystal panel has the gamma characteristic that is normally about $\gamma=2$, it is impossible to perform the correction of the video signal gain for the decrease of the luminance of the backlight precisely for all the levels of gray scale. However, these disadvantages will not cause a serious problem because they are visually less obtrusive on a large-motion screen.

As shown in FIG. 13, when the motion of the display image is small, the persistent response of the backlight largely overlaps with the write into the liquid crystal panel/response of the liquid crystal in the upper and lower portions of the screen. In this case, however, with small motion of the display image, no contour blurring and coloring is generated. Note that the video signal gain control data is a normal value when the modulation pulse width is large because no reduction in luminance occurs, and thus there will be no degradation of the image quality due to signal saturation in a white peak portion of the video signal.

As described above, in the third embodiment, the lighting-up of the backlight is controlled so that as the motion of the display image is larger, the lighting-up time of the backlight including its persistence time overlaps less with the response time of the screen. With this control, it is possible to suppress occurrence of the problem of blurring and coloring of a moving contour.

In the above description, use of a liquid crystal display as the display device was exemplified. The present invention is not limited to this, but is effectively applicable to passive light modulation devices (light bulb type devices), that is, devices that display an image by controlling light from a light source, in general. An example of the passive light modulation devices other than the liquid crystal display is a digital micromirror device (DMD) display. Using the DMD display, a higher-quality image display apparatus can be realized.

In the above description, general phosphors were used as the phosphors for a fluorescent lamp. If a phosphor short in persistence is used, the problem of blurring and coloring of a moving contour can be improved compared with the case of using general phosphors. However, even using the short-persistence phosphor, the problem of generating flicker occurs. In addition, the problem of blurring and coloring of a moving contour occurs in the upper or lower portion of the screen when the total of the write time into the pixels, the response time of liquid crystal and the lighting-up time of the backlight exceeds the vertical period time. Therefore, the first to third embodiments described above are effective even for the case of using a short-persistence phosphor.

INDUSTRIAL APPLICABILITY

As described above, the image display apparatus of the present invention can reduce image contour blurring in a moving image, as well as reducing flicker in a still image, during display of a moving image using a light modulation device such as a liquid crystal display. This enables higher-quality image display.

What is claimed is:

1. An image display apparatus for displaying an image by driving a passive light modulation device based on a video signal compressed in a time axis direction the passive light modulation device modulating light from a light source in a pixel-by-pixel manner based on an electric signal, the image display apparatus comprising:

motion detection means for detecting an amount of motion of a display image based on the video signal;

modulation pulse generation means for generating modulation pulses different in period, phase or pulse width according to a detection result from the motion detection means;

light source driving means for enabling the light source to emit light at optimum timing corresponding to the motion amount by intermittently driving the light source according to the modulation pulses generated by the modulation pulse generation means; and comparison means for comparing the motion amount detected by the motion detection means with a predetermined amount, wherein the modulation pulse generation means outputs a first modulation pulse synchronizing with a vertical synchronizing signal and having a same frequency as the vertical synchronizing signal when the motion amount is greater than the predetermined amount, and outputs a second modulation pulse having a frequency higher than the first modulation pulse when the motion amount is smaller than the predetermined amount.

2. The image display apparatus of claim 1, wherein the first modulation pulse and the second modulation pulse have a same pulse duty.

3. The image display apparatus of claim 1, wherein the frequency of the second modulation pulse is high enough to prevent generation of flicker.

4. The image display apparatus of claim 1, wherein the modulation pulse generation means comprises:

first pulse generation means for outputting the first modulation pulse synchronizing with the vertical synchronizing signal and having the same frequency as the vertical synchronizing signal;

second pulse generation means for outputting the second modulation pulse having the frequency higher than the first modulation pulse output from the first pulse generation means; and selector means for selecting the first modulation pulse outputted from the first pulse generation means or the second modulation pulse outputted from the second pulse generation means and outputting the selected pulse.

5. An image display apparatus for displaying an image by driving a passive light modulation device based on a video signal compressed in a time axis direction, the passive light modulation device modulating light from a light source in a pixel-by-pixel manner based on an electric signal, the image display apparatus comprising:

motion detection means for detecting an amount of motion of a display image based on the video signal;

modulation pulse generation means for generating modulation pulses different in period, phase or pulse width according to a detection result from the motion detection means; and light source driving means for enabling the light source to emit light at optimum timing corresponding to the motion amount by intermittently driving the light source according to the modulation pulses generated by the modulation pulse generation means, wherein the motion detection means detects the motion amount for each of a plurality of predetermined regions in an entire display area of the passive light modulation device, the image display apparatus further comprises comparison means for comparing the motion amounts for the plurality of predetermined regions detected by the motion detection means with each other, and the modulation pulse generation means generates the modulation pulses different in synchronizing phase according to a comparison result from the comparison means.

6. The image display apparatus of claim 5, wherein the plurality of predetermined regions includes at least a first predetermined region in which data based on the video signal is written at a time comparatively early in one frame and a second predetermined region in which data based on the video signal is written at a time comparatively late in one frame, and the modulation pulse generation means generates a first modulation pulse having a synchronizing phase permitting emission of the light source at a comparatively early time when the motion amount in the first predetermined region detected by the motion detection means is greater than the motion amount in the second predetermined region, and generates a second modulation pulse having a synchronizing phase permitting emission of the light source at a comparatively late time when the motion amount in the first predetermined region detected by the motion detection means is smaller than the motion amount in the second predetermined region.

7. The image display apparatus of claim 6, wherein the modulation pulse generation means comprises:

count means for delaying a vertical synchronizing signal by a predetermined time according to the comparison result from the comparison means; and pulse output means for outputting a pulse based on the vertical synchronizing signal delayed by the count means.

8. The image display apparatus of claim 6, wherein when changing an output pulse with change of the comparison result from the comparison means, the modulation pulse generation means sequentially shifts the synchronizing phase of the output pulse stepwise by outputting a modulation pulse in a synchronizing phase somewhere between the synchronizing phase of the first modulation pulse and the synchronizing phase of the second modulation pulse.

9. The image display apparatus of claim 8, wherein the modulation pulse generation means comprises:

frame recursive low-pass filter means for outputting motion position data capable of taking on three or more values based on the comparison result from the comparison means;

count means for delaying a vertical synchronizing signal based on the motion position data outputted from the frame recursive low-pass filter means; and pulse output means for outputting a pulse based on the vertical synchronizing signal delayed by the count means.

10. An image display apparatus for displaying an image by driving a passive light modulation device based on a video signal compressed in a time axis direction, the passive light modulation device modulating light from a light source in a pixel-by-pixel manner based on an electric signal, the image display apparatus comprising:

motion detection means for detecting an amount of motion of a display image based on the video signal;

modulation pulse generation means for generating modulation pulses different in period, phase or pulse width according to a detection result from the motion detection means;

light source driving means for enabling the light source to emit light at optimum timing corresponding to the motion amount by intermittently driving the light source according to the modulation pulses generated by the modulation pulse generation means; and pulse width determination means for determining the pulse width of the modulation pulses based on the motion amount detected by the motion detection means, wherein the modulation pulse generation means generates the modulation pulses having the pulse width determined by the pulse width determination means.

11. The image display apparatus of claim 10, wherein the pulse width determined by the pulse width determination means becomes smaller as the motion amount detected by the motion detection means is greater, and becomes greater as the motion amount is smaller.

12. The image display apparatus of claim 10, further comprising:

gain determination means for determining a gain of the video signal based on the motion amount detected by the motion detection means; and gain control means for controlling the gain of the video signal according to the gain determined by the gain determination means.

13. The image display apparatus of claim 12, wherein the gain determined by the gain determination means becomes greater as the pulse width determined by the pulse width determination means is smaller, and becomes smaller as the pulse width is greater.

14. The image display apparatus of claim 12, wherein the pulse width determination means and the gain determination means are a ROM table.

15. An image display apparatus for displaying an image by driving a passive light modulation device based on a video signal compressed in a time axis direction, the passive light modulation device modulating light from a light source in a pixel-by-pixel manner based on an electric signal, the image display apparatus comprising:

motion detection means for detecting an amount of motion of a display image based on the video signal;

modulation pulse generation means for generating modulation pulses different in period, phase or pulse width according to a detection result from the motion detection means; and light source driving means for enabling the light source to emit light at optimum timing corresponding to the motion amount by intermittently driving the light source according to the modulation pulses generated by the modulation pulse generation means, wherein the motion detection means detects the motion amount based on a data difference between two continuous frames, and the motion detection means comprises:

frame memory means for delaying the video signal by one frame;

subtraction means for subtracting one of the video signal and a video signal delayed by the frame memory means from the other;

absolute means for calculating an absolute of a subtraction result from the subtraction means; and accumulation means for accumulating, for one frame, an output of the absolute means.

16. An image display method for displaying an image by driving a passive light modulation device based on a video signal compressed in a time axis direction, the passive light modulation device modulating light from a light source in a pixel-by-pixel manner based on an electric signal, the image display method comprising:

detecting an amount of motion of a display image based on the video signal;

generating modulation pulses different in period, phase or pulse width according to a detection result in the detecting of the amount of motion operation; and emitting light from the light source at optimum timing corresponding to the motion amount by intermittently driving the light source according to the modulation pulses generated in the generating of the modulation pulses operation, wherein the generating of the modulation pulses comprises outputting a first modulation pulse synchronizing with a vertical synchronizing signal and having a same frequency as the vertical synchronizing signal when the motion amount detected in the detecting of the amount of motion operation is greater than a predetermined amount, and outputting a second modulation pulse having a frequency higher than the first modulation pulse when the motion amount is smaller than the predetermined amount.

17. The image display method of claim 16, wherein the first modulation pulse and the second modulation pulse have a same pulse duty.

18. The image display method of claim 16, wherein the frequency of the second modulation pulse is high enough to prevent generation of flicker.

19. An image display method for displaying an image by driving a passive light modulation device based on a video signal compressed in a time axis direction, the passive light modulation device modulating light from a light source in a pixel-by-pixel manner based on an electric signal, the image display method comprising:

detecting an amount of motion of a display image based on the video signal;

generating modulation pulses different in period, phase or pulse width according to a detection result in the detecting of the amount of motion operation; and emitting light from the light source at optimum timing corresponding to the motion amount by intermittently driving the light source according to the modulation pulses generated in the generating of the modulation pulses operation, wherein the detecting of the amount of motion operation comprises detecting the motion amount for each of a plurality of predetermined regions in an entire display area of the passive light modulation device, the image display method further comprises comparing the motion amounts for the plurality of predetermined regions detected by the detecting of the amount of motion operation with each other, the generating of the modulation pulses operation comprises generating the modulation pulses different in synchronizing phase based on a comparison result from the comparing operation, the plurality of predetermined regions includes at least a first predetermined region in which data based on the video signal is written at a time comparatively early in one frame and a second predetermined region in which data based on the video signal is written at a time comparatively late in one frame, and the generating of the modulation pulses operation comprises generating a first modulation pulse having a synchronizing phase permitting emission of the light source at a comparatively early time when the motion amount in the first predetermined region is greater than the motion amount in the second predetermined region, and generating a second modulation pulse having a synchronizing phase permitting emission of the light source at a comparatively late time when the motion amount in the first predetermined region is smaller than the motion amount in the second predetermined region.

20. The image display method of claim 19, wherein the generating of the modulation pulses operation comprises:

delaying a vertical synchronizing signal by a predetermined time according to the comparison result in the comparison operation; and outputting a pulse based on the vertical synchronizing signal delayed in the delaying of the vertical synchronizing signal operation.

21. The image display method of claim 19, wherein the generating of the modulation pulses operation comprises, when an output pulse is changed with change of the motion amount for each of the plurality of predetermined regions detected in the detecting of the amount of motion operation, sequentially shifting the synchronizing phase of the output pulse stepwise by outputting a modulation pulse in a synchronizing phase somewhere between the synchronizing phase of the first modulation pulse and the synchronizing phase of the second modulation pulse.

22. An image display method for displaying an image by driving a passive light modulation device based on a video signal compressed in a time axis direction, the passive light modulation device modulating light from a light source in a pixel-by-pixel manner based on an electric signal, the image display method comprising:

detecting an amount of motion of a display image based on the video signal;

generating modulation pulses different in period, phase or pulse width according to a detection result in the detecting of the amount of motion operation;

emitting light from the light source at optimum timing corresponding to the motion amount by intermittently driving the light source according to the modulation pulses generated in the generating of the modulation pulses operation; and determining the pulse width of the modulation pulses based on the motion amount detected in the detecting of the amount of motion operation, wherein the generating of the modulation pulses operation comprises generating the modulation pulses having the pulse width determined in the determining of the pulse width operation, and the pulse width determined in the determining of the pulse width operation becomes smaller as the motion amount detected in the detecting of the amount of motion operation is greater, and becomes greater as the motion amount is smaller.

23. An image display method for displaying an image by driving a passive light modulation device based on a video signal compressed in a time axis direction, the passive light modulation device modulating light from a light source in a pixel-by-pixel manner based on an electric signal, the image display method comprising:

detecting an amount of motion of a display image based on the video signal;

generating modulation pulses different in period, phase or pulse width according to a detection result in the detecting of the amount of motion operation;

emitting light from the light source at optimum timing corresponding to the motion amount by intermittently driving the light source according to the modulation pulses generated in the generating of the modulation pulses operation;

determining the pulse width of the modulation pulses based on the motion amount detected in the detecting of the amount of motion operation;

determining a gain of the video signal based on the motion amount detected in the detecting of the amount of motion operation; and controlling the gain of the video signal according to the gain determined in the determining of the gain operation, wherein the generating of the modulation pulses operation comprises generating the modulation pulses having the pulse width determined in the determining of the pulse width operation.

24. The image display method of claim 23, wherein the gain determined in the determining of the gain operation becomes greater as the pulse width determined in the determining of the pulse width operation is smaller, and becomes smaller as the pulse width is greater.

* * * * *